US007881489B2

(12) United States Patent
Matsuzawa et al.

(10) Patent No.: US 7,881,489 B2
(45) Date of Patent: Feb. 1, 2011

(54) ULTRASONIC TRANSDUCER AND ULTRASONIC SPEAKER USING THE SAME

(75) Inventors: Kinya Matsuzawa, Shiojiri (JP); Hirokazu Sekino, Chino (JP); Yoshiki Fukui, Suwa (JP); Shinichi Miyazaki, Suwa (JP)

(73) Assignee: Seiko Epson Corporation (JP)

( * ) Notice: Subject to any disclaimer, the term of this patent is extended or adjusted under 35 U.S.C. 154(b) by 1083 days.

(21) Appl. No.: 11/629,248

(22) PCT Filed: May 11, 2005

(86) PCT No.: PCT/JP2005/009017

§ 371 (c)(1),
(2), (4) Date: Dec. 11, 2006

(87) PCT Pub. No.: WO2005/122638

PCT Pub. Date: Dec. 22, 2005

(65) Prior Publication Data

US 2008/0013761 A1 Jan. 17, 2008

(30) Foreign Application Priority Data

Jun. 14, 2004 (JP) ..... 2004-175471

(51) Int. Cl.
*H04R 25/00* (2006.01)

(52) U.S. Cl. ..... 381/396; 381/171; 381/178; 381/423

(58) Field of Classification Search ..... 381/150, 381/152, 162, 170, 171, 173–174, 176, 178, 381/396, 399, 423, 431; 310/311, 322, 325
See application file for complete search history.

(56) References Cited

U.S. PATENT DOCUMENTS

| | | | |
|---|---|---|---|
| 4,246,449 | A | 1/1981 | Biber |
| 4,311,881 | A | 1/1982 | Reynard |
| 4,796,725 | A | 1/1989 | Katayama |
| 5,450,498 | A | 9/1995 | Whitehead |
| 6,201,874 | B1 | 3/2001 | Croft, III et al. |
| 6,584,206 | B2 | 6/2003 | Ohashi |
| 6,870,937 | B1 | 3/2005 | Hirosaki et al. |
| 2005/0269899 | A1 | 12/2005 | Matsuzawa et al. |

FOREIGN PATENT DOCUMENTS

| | | |
|---|---|---|
| JP | S51-4331 | 1/1976 |

(Continued)

OTHER PUBLICATIONS

International Search Report and Written Opinion of the ISA for PCT/JP2005/009017, ISA/JP, Tokyo, mailed Sep. 6, 2005.

*Primary Examiner*—Suhan Ni
(74) *Attorney, Agent, or Firm*—Harness, Dickey & Pierce, P.L.C.

(57) ABSTRACT

An ultrasonic transducer includes: a fixed electrode having corrugations on the surface; a vibrating film having an electrode layer and disposed on the surface of the fixed electrode; and a holding member which holds the fixed electrode and the vibrating film. The ultrasonic transducer is driven by applying an AC signal between the electrode layer of the vibrating film and the fixed electrode, and generates a sound pressure of at least 120 dB within a frequency range from 20 kHz to 120 kHz.

29 Claims, 15 Drawing Sheets

FOREIGN PATENT DOCUMENTS

| | | | |
|---|---|---|---|
| JP | S51-004331 | | 1/1976 |
| JP | S53-85128 | | 7/1978 |
| JP | S53-085128 | | 7/1978 |
| JP | S55-149600 | | 11/1980 |
| JP | S56-010799 | | 2/1981 |
| JP | S56-10799 | | 2/1981 |
| JP | S58-046800 | | 3/1983 |
| JP | S58-46800 | | 3/1983 |
| JP | 60-157399 | A | 8/1985 |
| JP | 64-4199 | A | 1/1989 |
| JP | 02-052599 | | 2/1990 |
| JP | 02-52599 | | 2/1990 |
| JP | 2-179200 | A | 7/1990 |
| JP | 9-500247 | A | 1/1997 |
| JP | 2000-224687 | | 8/2000 |
| JP | 2001-231099 | | 8/2001 |
| JP | 2002-135896 | A | 5/2002 |
| JP | 2002-526004 | A | 8/2002 |
| JP | 2004-501524 | | 1/2004 |
| JP | 2005-27186 | A | 1/2005 |
| JP | 2005-39439 | A | 2/2005 |
| JP | 2005-117103 | A | 4/2005 |
| JP | 2005-223820 | A | 8/2005 |
| JP | 2005-348122 | | 12/2005 |
| WO | 01/52437 | A1 | 7/2001 |

ULTRASONIC TRANSDUCER AND ULTRASONIC SPEAKER USING THE SAME

TECHNICAL FIELD

The present invention relates to an electrostatic ultrasonic transducer that generates a constant high sound pressure over a wide frequency band, and an ultrasonic speaker using the same.

Priority is claimed on Japanese Patent Application No. 2004-175471, filed Jun. 14, 2004, the content of which is incorporated herein by reference.

BACKGROUND ART

The configuration of a conventional ultrasonic transducer is shown in FIG. 18. Most conventional ultrasonic transducers are resonant ultrasonic transducers using a piezoelectric ceramic as a vibrating element. The ultrasonic transducer shown in FIG. 18 uses the piezoelectric ceramic as the vibrating element to perform both conversion from an electric signal to ultrasonic waves and conversion from ultrasonic waves to the electric signal (transmission and reception of ultrasonic waves). The bimorph-type ultrasonic transducer shown in FIG. 18 comprises two piezoelectric ceramics 61 and 62, a cone 63, a case 64, leads 65 and 66, and a screen 67.

The piezoelectric ceramics 61 and 62 are stuck together, and the leads 65 and 66 are respectively connected to the ceramics 61 and 62 at the surfaces thereof opposite to the stuck surface.

Since the resonant ultrasonic transducer uses a resonance phenomena of the piezoelectric ceramic, excellent ultrasonic transmission and reception characteristics can be obtained only in a relatively narrow frequency band near the resonance frequency.

In addition to the resonant ultrasonic transducer shown in FIG. 18, the electrostatic ultrasonic transducer has been heretofore known as a broadband oscillation-type ultrasonic transducer which can generate relatively high sound pressure over a wide frequency band.

However, as shown in FIG. 19, regarding the maximum value of the sound pressure, the electrostatic ultrasonic transducer has a value as low as 120 dB or lower as shown by the curve Q1 in FIG. 19 while the resonant ultrasonic transducer has a value as high as 130 dB or higher as shown by the curve Q2 in FIG. 19. Hence the sound pressure is slightly insufficient for using the electrostatic ultrasonic transducer as an ultrasonic speaker. Such ultrasonic speaker using the electrostatic ultrasonic transducer is disclosed in, for example, Published Japanese translation Nos. 2002-526004 and 2004-501524 of PCT International Applications.

Here, explanation will be given of the ultrasonic speaker in which the ultrasonic transducer is utilized. In the ultrasonic speaker, an ultrasonic wave referred to as a carrier wave, is AM modulated by an audio signal (a signal in an audio-frequency band), and when this is radiated to the air the original audio signal is self-reproduced in the air due to the nonlinearity of the air.

More specifically, since the sound waves are compression waves that propagate through the air as a medium, dense parts and sparse parts of the air appear remarkably in a process of propagation of the modulated ultrasonic waves. Since the speed of sound is fast in the dense parts and is slow in the sparse parts, a distortion occurs in the modulated wave itself. As a result, the waveform is separated into carrier waves (ultrasonic wave) and audio waves (original audio signal), and a human can hear only the audio sound (original audio signal) of 20 kHz or below. This principle is generally referred to as a parametric array effect.

An ultrasonic sound pressure of not lower than 120 dB is necessary in order that the parametric array effect appears sufficiently, but it is difficult to achieve this figure by the electrostatic ultrasonic transducer. Hence, a ceramic piezoelectric element such as PZT or a polymer piezoelectric element such as PVDF has been used as an ultrasonic wave-transmitting member.

However, the piezoelectric element has a sharp resonance point regardless of the material, and is driven at the resonance frequency and put to practical use as an ultrasonic speaker. Therefore, the frequency domain that can ensure a high sound pressure is quite narrow. That is, it can be said that the piezoelectric element has eventually a narrow-band.

Generally, the maximum audio frequency band of a human being is about 20 Hz to 20 kHz, with a band of about 20 kHz. That is, in the ultrasonic speaker, the original audio signal cannot be demodulated with fidelity, unless a high sound pressure is ensured over the frequency band of 20 kHz in the ultrasonic region.

It can be easily understood that it is difficult to reproduce (demodulate) the broadband of 20 kHz with fidelity with the conventional ultrasonic speaker using the piezoelectric element.

Actually, the ultrasonic speaker using the conventional resonant ultrasonic transducer shown in FIG. 6 has the following problems: (1) the band is narrow and reproduced sound quality is low; (2) if the AM modulation factor is too high, the demodulated sound is distorted, and hence the modulation factor can be increased up to about 0.5 at maximum; (3) if the input voltage is increased (if the volume is increased), vibration of the piezoelectric element becomes unstable, and the sound is distorted When the voltage is further increased, the piezoelectric element itself is likely to be broken; and (4) arraying, enlargement, and miniaturization are difficult, and hence the production cost is high.

DISCLOSURE OF INVENTION

The electrostatic ultrasonic transducer according to the present invention can solve all of the problems of the aforementioned conventional technology, and by devising an electrode configuration as mentioned later, also solves the sound pressure insufficiency which was a problem with the electrostatic ultrasonic transducer, and is thus a device which is very applicable to ultrasonic speakers for such use.

For the frequency characteristics also in FIG. 19, as shown by the curve Q3, it can be seen that a sound pressure of 120 dB or higher over a wide frequency band can be obtained.

An object of the present invention is, therefore, to provide an ultrasonic transducer that can generate an acoustic signal of a sound pressure level sufficiently high to obtain the parametric array effect over a wide frequency band, and an ultrasonic speaker using the same.

In order to achieve the above object, the ultrasonic transducer of the present invention comprises: a fixed electrode having corrugations on the surface; a vibrating film having an electrode layer and disposed on the surface of the fixed electrode; and a holding member which holds the fixed electrode and the vibrating film, the ultrasonic transducer being driven by applying an AC signal between the electrode layer of the vibrating film and the fixed electrode, wherein the ultrasonic transducer generates a sound pressure of at least 120 dB within a frequency range from 20 kHz to 120 kHz.

In the ultrasonic transducer of the present invention having the above configuration, by devising a configuration for the fixed electrode and the vibrating film, a sound of at least 120 dB which is sufficient to obtain the parametric array effect over a wide frequency band of a frequency from 20 kHz to 120 kHz can be obtained. Therefore various carrier frequencies can be selected, so that control such as for the sound spread or the sound range can be easily performed.

Moreover, in the ultrasonic transducer of the present invention, a fluctuation in sound pressure of 120 dB and higher within a frequency range from 20 kHz to 120 kHz may be within 6 dB (±3 dB).

In the ultrasonic transducer of the present invention having such a configuration, the fluctuation in sound pressure of 120 dB and higher within a frequency range from 20 kHz to 120 kHz is within 6 dB (±3 dB), so that a stable acoustic output is obtained.

Furthermore, in the ultrasonic transducer of the present invention, the corrugations of the fixed electrode may comprise a plurality of circular grooves formed in concentric circles.

In the ultrasonic transducer of the present invention having such a configuration, the corrugations of the fixed electrode comprise a plurality of circular grooves formed in concentric circles. Therefore a plurality of capacitors are formed between the fixed electrode and the vibrating film, and by combining the outputs from these, a high sound pressure sufficient to obtain the parametric array effect in the aforementioned wide frequency band is obtained. Moreover, in this case, since the circular grooves on the outer peripheral side can vibrate in large amplitude, this has the merit that directionality becomes sharpened.

Moreover, in the ultrasonic transducer of the present invention, the corrugations of the fixed electrode may comprise a plurality of elliptical grooves formed in concentric ellipses.

In the ultrasonic transducer of the present invention having such a configuration, the corrugations of the fixed electrode comprise a plurality of elliptical grooves formed in concentric ellipses. The case of this groove shape also has the same effect as when the corrugations comprise a plurality of circular grooves formed in concentric circles.

Furthermore, in the ultrasonic transducer of the present invention, the corrugations of the fixed electrode may comprise a plurality of straight line grooves.

In the ultrasonic transducer of the present invention having such a configuration, the corrugations of the fixed electrode comprise a plurality of straight line grooves. The case of this groove shape also has the same effect as when the corrugations comprise a plurality of elliptical grooves formed in concentric ellipses. When these are straight line grooves, the fixed electrode can be most easily manufactured.

Moreover, in the ultrasonic transducer of the present invention, the corrugations of the fixed electrode may comprise a plurality of free-form curved grooves.

In the ultrasonic transducer of the present invention having such a configuration, the corrugations of the fixed electrode comprise a plurality of free-form curved grooves. The case of this groove shape also has the same effect as when the corrugations comprise a plurality of circular grooves formed in concentric circles.

Furthermore, in the ultrasonic transducer of the present invention, the cross-sectional shape of the corrugations or grooves may be made in any one of a rectangular shape, a tapered shape, and with a lower portion of an approximately semicircular shape.

In the ultrasonic transducer of the present invention having such a configuration, the cross-sectional shape of the grooves is made in any one of a rectangular shape, a tapered shape, and with a lower portion of an approximately semicircular shape. Also with any one of these shapes a plurality of capacitors are formed between the fixed electrode and the vibrating film, and by combining the outputs from these, a high sound pressure sufficient to obtain the parametric array effect in the aforementioned wide frequency band is obtained.

Moreover, in the ultrasonic transducer of the present invention, the corrugations of the fixed electrode may comprise a plurality of cylindrical holes.

In the ultrasonic transducer of the present invention having such a configuration, a large number of capacitors are formed between the fixed electrode and the vibrating film, and by combining the outputs from these, a high sound pressure sufficient to obtain the parametric array effect in the aforementioned wide frequency band is obtained.

Furthermore, in the ultrasonic transducer of the present invention, the corrugations of the fixed electrode may comprise a plurality of conical holes.

In the ultrasonic transducer of the present invention having such a configuration, a large number of capacitors are formed between the fixed electrode and the vibrating film, and by combining the outputs from these, a high sound pressure sufficient to obtain the parametric array effect in the aforementioned wide frequency band is obtained.

Moreover, in the ultrasonic transducer of the present invention, the corrugations of the fixed electrode may comprise grooves of any one of; a plurality of circular grooves formed in concentric circles, a plurality of elliptical grooves formed in concentric ellipses, and a plurality of straight line grooves, or a combination of such grooves, and holes of either one of a plurality of cylindrical holes and a plurality of conical holes, or a combination of such holes.

In the ultrasonic transducer of the present invention having such a configuration, the corrugations of the fixed electrode comprise grooves of any one of; a plurality of circular grooves formed in concentric circles, a plurality of elliptical grooves formed in concentric ellipses, and a plurality of straight line grooves, or a combination of such grooves, and holes of either one of a plurality of cylindrical holes and a plurality of conical holes, or a combination of such holes. Therefore, a large number of capacitors are formed between the fixed electrode and the vibrating film, and by combining the outputs from these, a high sound pressure sufficient to obtain the parametric array effect in the aforementioned wide frequency band is obtained.

Furthermore, in the ultrasonic transducer of the present invention, a groove portion or continuously disposed holes may be provided on the upper surface of protrusions of the corrugations of the fixed electrode.

In the ultrasonic transducer of the present invention having such a configuration, the groove portion or continuously disposed holes are provided on the upper surface of protrusions of the corrugations of the fixed electrode. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the groove portion may be formed in a continuous groove shape.

In the ultrasonic transducer of the present invention having such a configuration, the groove portion is formed in a continuous groove shape. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the groove portion may comprise a plurality of circular grooves formed in concentric circles.

In the ultrasonic transducer of the present invention having such a configuration, the groove portion comprises a plurality of circular grooves formed in concentric circles. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the groove portion comprises a plurality of elliptical grooves formed in concentric ellipses.

In the ultrasonic transducer of the present invention having such a configuration, the groove portion comprises a plurality of elliptical grooves formed in concentric ellipses. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the groove portion may comprise a plurality of straight line grooves.

In the ultrasonic transducer of the present invention having such a configuration, the groove portion comprises a plurality of straight line grooves. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the groove portion may comprise a plurality of free-form curved grooves.

In the ultrasonic transducer of the present invention having such a configuration, the groove portion comprises a plurality of free-form curved grooves. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the cross-section shape of the groove portion may be made in any one of a rectangular shape, a tapered shape, and with a lower portion of an approximately semicircular shape.

In the ultrasonic transducer of the present invention having such a configuration, the cross-section shape of the groove portion is made in any one of a rectangular shape, a tapered shape, and with a lower portion of an approximately semicircular shape. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the holes may be formed as a plurality of cylindrical holes disposed continuously in a concentric circle shape or in a straight line shape.

In the ultrasonic transducer of the present invention having such a configuration, the holes are formed as a plurality of cylindrical holes disposed continuously in a concentric circle shape or in a straight line shape. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the holes may be formed as a plurality of conical holes disposed continuously in a concentric circle shape or in a straight line shape.

In the ultrasonic transducer of the present invention having such a configuration, the holes are formed as a plurality of conical holes disposed continuously in a concentric circle shape or in a straight line shape. As a result, the degree of attraction of the vibrating film to the fixed electrode is weakened, and the conversion efficiency for converting the electrical signal into the sound wave signal is increased, so that the output sound pressure level can be increased.

Moreover, the electrostatic capacity between the vibrating film and the fixed electrode is reduced so that the drive current for the ultrasonic transducer can be reduced.

Furthermore, in the ultrasonic transducer of the present invention, the fixed electrode may comprise a single conductive member.

In the ultrasonic transducer of the present invention having such a configuration, the pair of fixed electrodes can be formed of a single conductive member of for example, a conductive material such as SUS, brass, iron, or nickel.

Furthermore, in the ultrasonic transducer of the present invention, the fixed electrode may comprise a plurality of conductive members.

In the ultrasonic transducer of the present invention having such a configuration, the fixed electrode can be formed of a plurality of conductive members.

Moreover, in the ultrasonic transducer of the present invention, the vibrating film is a thin film with the electrode layer formed on one side of a nonconductive polymer film.

In the ultrasonic transducer of the present invention having such a configuration, the vibrating film has the electrode layer formed on one side of the nonconductive polymer film. As a result, the vibrating film can be easily prepared.

Furthermore, in the ultrasonic transducer of the present invention, the vibrating film is a thin film obtained by forming said electrode layer between two nonconductive polymer films.

In the ultrasonic transducer of the present invention having such a configuration, the vibrating film is obtained by forming the electrode layer between two nonconductive layers (nonconductive polymer films). As a result, the insulation process for the fixed electrode side becomes unnecessary, so that the manufacture of the ultrasonic transducer becomes easy.

Moreover, in the ultrasonic transducer of the present invention, a single-polarity DC bias voltage may be applied to the electrode layer of the vibrating film.

In the ultrasonic transducer of the present invention having such a configuration, a single-polarity DC bias voltage is applied to the vibrating film. Therefore, since the electric charge of the same polarity is accumulated in the electrode layer of the vibrating film at all times, the vibrating film receives electrostatic attraction, and vibrates corresponding to the polarity of the AC signal applied between the fixed electrode and the vibrating film.

Furthermore, in the ultrasonic transducer of the present invention, a single-polarity DC bias voltage may be applied to the fixed electrode.

In the ultrasonic transducer of the present invention having such a configuration, a single-polarity DC bias voltage is applied to the fixed electrode. Therefore, an AC signal which is superimposed on the DC bias voltage is applied between the fixed electrode and the electrode layer of the vibrating film, and the vibrating film receives electrostatic attraction, and vibrates corresponding to the polarity of the AC signal.

Moreover, in the ultrasonic transducer of the present invention, the holding member which holds the fixed electrodes and the vibrating film may be formed from an insulating material.

In the ultrasonic transducer of the present invention having such a configuration, the member which holds the fixed electrodes and the vibrating film is formed from an insulating material. As a result, the electrical insulation between the fixed electrodes and the vibrating film is maintained.

Furthermore, in the ultrasonic transducer of the present invention, the vibrating film may be fixed by applying tension in four right-angle directions on the film plane.

In the ultrasonic transducer of the present invention having such a configuration, the vibrating film is fixed by applying tension in four right-angle directions on the film plane. Conventionally, it has been necessary to apply a DC bias voltage of several hundred volts to the vibrating film in order to attract the vibrating film to the fixed electrode side. However, by fixing the vibrating film by applying tension to the film at the time of preparing the film unit, the same effect as the tension borne by the conventional DC bias voltage is realized. Therefore, the DC bias voltage can be reduced.

Moreover, in the ultrasonic transducer of the present invention, the ultrasonic transducer may use forced vibration under an electrostatic force generated by a drive voltage, rather than vibration at the resonance point of natural vibration.

In the ultrasonic transducer of the present invention having such a configuration, the ultrasonic transducer uses forced vibration under an electrostatic force generated by the drive voltage, rather than vibration at the resonance point of natural vibration. Therefore by changing the level and the frequency of the drive voltage, an acoustic signal of a desired sound pressure level can be generated across a wide frequency band.

Furthermore, the ultrasonic speaker of the present invention comprises: an ultrasonic transducer according to any one of those mentioned above; a signal source which generates signal waves in the audio frequency band; a carrier wave-supply unit which generates and outputs carrier waves in the ultrasonic frequency band; and a modulating unit which modulates the carrier waves according to signal waves in the audio frequency band output from the signal source, and, the ultrasonic transducer is driven by a modulated signal output from the modulating unit and applied between the fixed electrode and the electrode layer of the vibrating film.

In the ultrasonic speaker of the present invention having such a configuration, the signal waves in the audio frequency band are generated by the signal source, and the carrier waves in the ultrasonic frequency band are generated and output by the carrier wave-supply unit. Furthermore, the carrier waves are modulated by the modulating unit according to the signal waves in the audio frequency band, and the ultrasonic transducer is driven by the modulated signal output from the modulating unit, which is applied between the fixed electrode and the electrode layer of the vibrating film.

Since the ultrasonic speaker of the present invention is constructed by using the ultrasonic transducer having the above configuration, then in the case where used as a broadband ultrasonic speaker, an ultrasonic speaker of low cost and with good sound quality can be realized compared to the conventional electrostatic ultrasonic speaker that uses a piezoelectric material.

Moreover since the ultrasonic speaker is well adapted to broadband, various carrier frequencies can be used, so that control such as for the sound spread or the sound range is also possible.

BEST MODE FOR CARRYING OUT THE INVENTION

Now, embodiment of the present invention will be described in detail with reference to the drawings.

Figure 1:
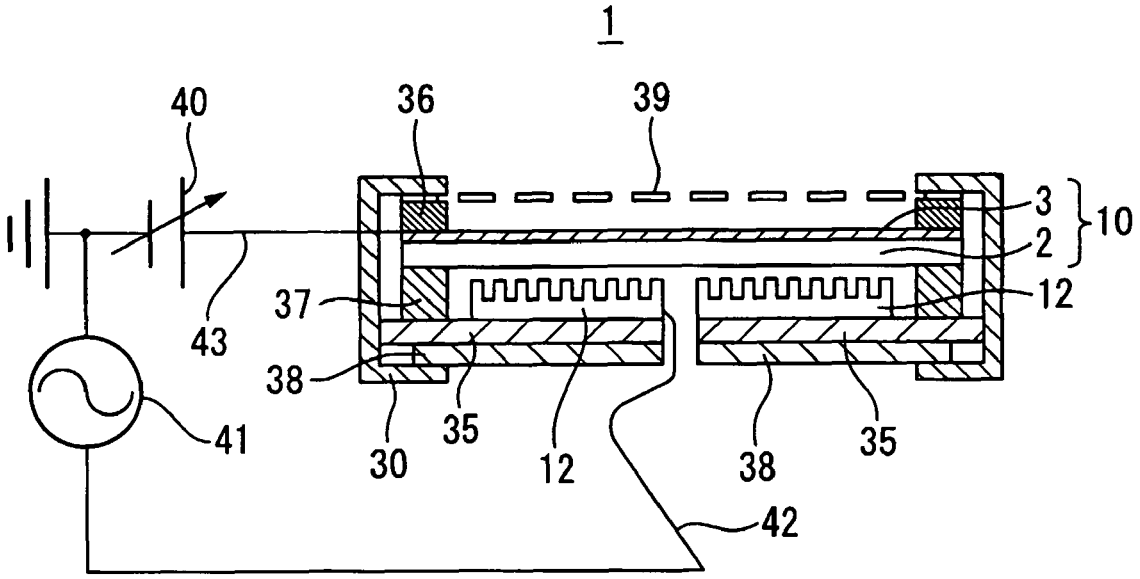
FIG. 1 is a cross-sectional view showing an ultrasonic transducer according to a first embodiment of the present invention.

As shown in FIG. 1, the ultrasonic transducer 1 according to the first embodiment of the present invention comprises a fixed electrode 12 having corrugations on the surface, a vibrating film 10 having an electrode layer 3 and disposed on the surface of the fixed electrode 12; and a holding member 30 which holds the fixed electrode 12 and the vibrating film 10. The ultrasonic transducer 1 is driven by applying an AC signal between the electrode layer 3 of the vibrating film 10 and the fixed electrode 12.

As described later in detail, the ultrasonic transducer 1 can generates a sound pressure of at least 120 dB within a frequency range from 20 kHz to 120 kHz. Further, in the ultrasonic transducer 1, a fluctuation in sound pressure of equal to or higher than 120 dB within a frequency range from 20 kHz to 120 kHz is within 6 dB (±3 dB).

In FIG. 1, the ultrasonic transducer 1 is classified into electrostatic type which uses a dielectric film 2 (insulator) such as PET (polyethylene terephthalate resin) having a thickness of about 3 to 10 μms, as the vibrating film 10. An electrode layer 3 formed as a metal foil of aluminum or the like, is integrally formed with the dielectric film 2 on the upper face thereof by a process such as vacuum evaporation. The vibrating film 10 is thus formed from the dielectric film 2 and the electrode layer 3. A fixed electrode 12 formed of brass is provided so as to come in contact with the lower face of the dielectric film 2. The fixed electrode 12 is connected with a lead 42, and is fixed to a base plate 35 formed of bakelite or the like.

The electrode layer 3 of the vibrating film 10 is connected to a DC bias power supply 40 through a lead 43. A DC bias voltage of about 50 to 150 V is applied to the electrode layer 3 of the vibrating film 10 at all times by the DC bias power supply 40, so that the electrode layer 3 of the vibrating film 10 is attracted toward the fixed electrode 12. A signal source 41 is connected to the fixed electrode 12 via the lead 42.

The dielectric film 2, the electrode layer 3, and the base plate 35 are tightly fitted in the holding member 30 together with metal rings 36, 37 and 38, and a mesh 39.

A plurality of fine grooves of about several tens to several hundred micro meters having a nonuniform, irregular shape is formed in the surface of the fixed electrode 12 on the dielectric film 2 side. The fine grooves form a gap between the fixed electrode 12 and the dielectric film 2, and hence the distribution of capacitance between the electrode layer 3 and the fixed electrode 12 slightly changes.

The random fine grooves are formed by roughening the surface of the fixed electrode 12 manually with a rasp. In the electrostatic ultrasonic transducer, by forming innumerable capacitors having different sizes of the gap and different depths in this manner, broadband frequency characteristic are obtained.

In the ultrasonic transducer having the above configuration, a rectangular wave signal (50 to 150 Vp-p) is applied from the signal source 41 between the electrode layer 3 of the vibrating film 10 and the fixed electrode 12, with the DC bias voltage being applied to the electrode layer 3 of the vibrating film 10.

Figure 19:
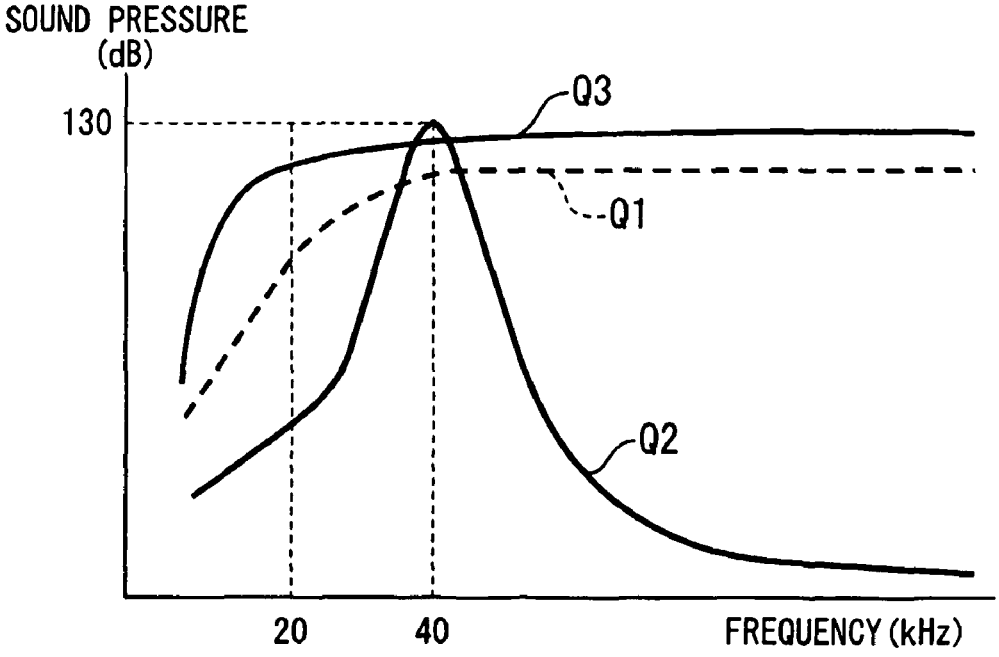
FIG. 19 is a graph showing the frequency characteristic of the ultrasonic transducer according to the embodiment of the present invention, together with the frequency characteristic of a conventional ultrasonic transducer.

It should be noted here that, as shown by the curve Q2 in FIG. 19, the frequency characteristic of the conventional resonant ultrasonic transducer is −30 dB with respect to the maximum sound pressure for a frequency of ±5 kHz with respect to a center frequency (resonance frequency of the piezoelectric ceramic) having a maximum sound pressure of for example 40 kHz.

On the other hand, regarding the frequency characteristics of the ultrasonic transducer according to the first embodiment of the present invention of the above construction, a high sound pressure of at least 120 dB over a wide frequency band from 20 kHz to 120 kHz is obtained. A fluctuation in sound pressure in this wide frequency band is approximately -6 dB compared to the maximum sound pressure.

The ultrasonic transducer (broadband electrostatic transducer) according to the first embodiment of the present invention shown in FIG. 1 has a capacity to satisfy the broadband property and a high sound pressure at the same time, as compared to the conventional ultrasonic transducer. This is because the vibrating film and the corrugations formed on the fixed electrode surface, form a vast amount of capacitors on the sound radiating surface, and by combining the various oscillations, a high sound pressure can be generated over a broadband.

Figure 2A:
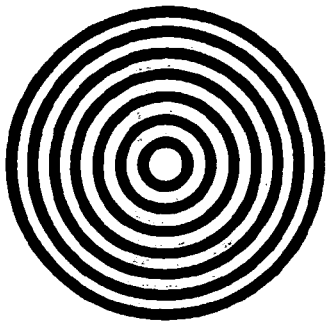
FIGS. 2A, 2B and 2C are plan views showing examples of the shape of fixed electrodes used in the ultrasonic transducer according to the first embodiment of the present invention.
Figure 2B:
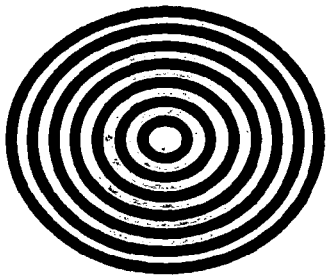

Examples of the fine grooves (may be referred to as corrugations hereinafter) formed on the fixed electrode 12 are shown in FIGS. 2A to 2B.

Figure 2C:
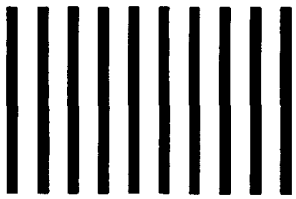

As shown in FIG. 2A, the shape of the fixed electrode 12 (the shape of the corrugations of the fixed electrode 12) can be for example a circular groove structure made from a plurality of circular grooves formed in concentric circles. As shown in FIG. 2B, an elliptical groove structure made from a plurality of elliptical grooves formed in concentric ellipses may also be utilized. A straight line structure as shown in FIG. 2C made from a plurality of straight line grooves can be also utilized. From the point of production technology, the straight line structure is simpler, and thus preferable. In FIGS. 2A to 2C, the white portion denotes the grooves of the fixed electrode 12, while the black portion denotes protrusions which may be formed of or covered by the insulating material.

Figure 3A:
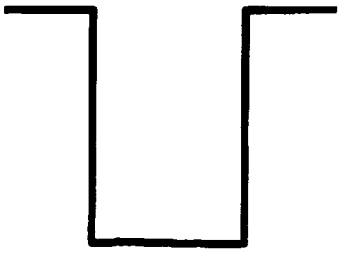
FIGS. 3A, 3B and 3C are cross-sectional views showing examples of groove bottom configurations of the fixed electrodes used in the ultrasonic transducer according to the first embodiment of the present invention.
Figure 3B:
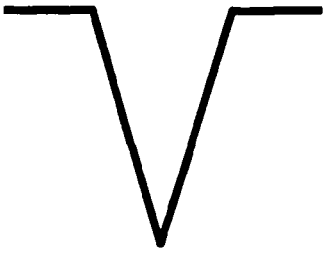
Figure 3C:
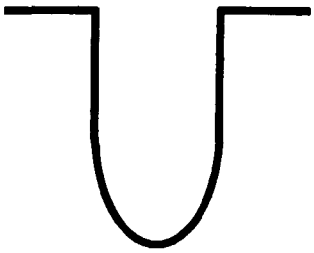

Furthermore, FIGS. 3A to 3C show the cross-sectional structure of the groove or the corrugation formed on the fixed electrode 12. Various shapes are considered such as a rectangular shape as shown in FIG. 3A, a tapered shape as shown in FIG. 3B, and a curve shape (lower portion of an approximately semicircular shape) as shown in FIG. 3C.

The material of the fixed electrode 12 needs only to be conductive, and for example aluminum, SUS, brass, iron, nickel, titanium, or electroconductive plastic may be used.

Figure 4A:
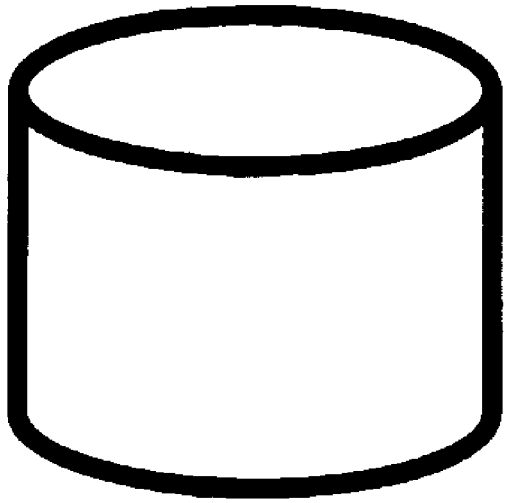
FIGS. 4A and 4B are schematic views showing hole patterns formed in the fixed electrode used in the ultrasonic transducer according to the first embodiment of the present invention.
Figure 4B:
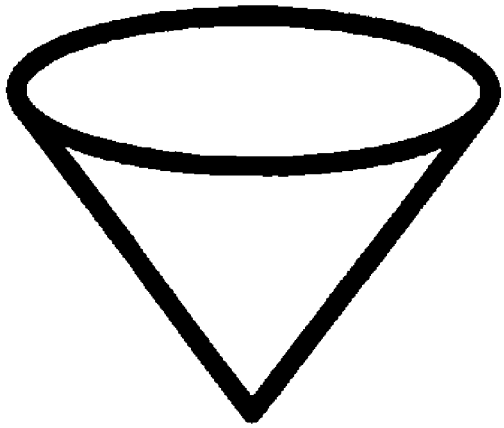

Surface roughness or the corrugations of the fixed electrode 12 may be formed by minute holes. FIGS. 4A to 4B show a few hole patterns for forming the corrugations on the surface of the fixed electrode 12. FIG. 4A is a cylindrical hole pattern, which is the simplest to produce. FIG. 4B shows conical holes of a taper shape. The effect of these holes is the same as the effect of grooves, and serves the role of forming a vast amount of capacitors between the fixed electrode surface and the vibrating film, and thus increasing the sound pressure.

The sound pressure increasing effect of the corrugations, the grooves and the holes formed in the fixed electrode 12, is as mentioned before. Also, the main cause of the broadband property (the generation of a high sound pressure across a wide frequency range) is attributable to the design where, rather than operating at the natural frequency (resonance point) of the free oscillation of the grooves or the holes, this is driven by forced oscillation or vibration by electrical energy in a predominant frequency domain.

The material of the fixed electrode 12 needs only to be conductive, and for example, a unit configuration of SUS, brass, iron, nickel, or electroconductive plastic is also possible. Moreover, since it is necessary to lighten the fixed electrode, a method such as subjecting a glass epoxy substrate or a paper phenol substrate generally used for a circuit substrate and the like to a plating process in a desired shape is also effective.

Figure 5:
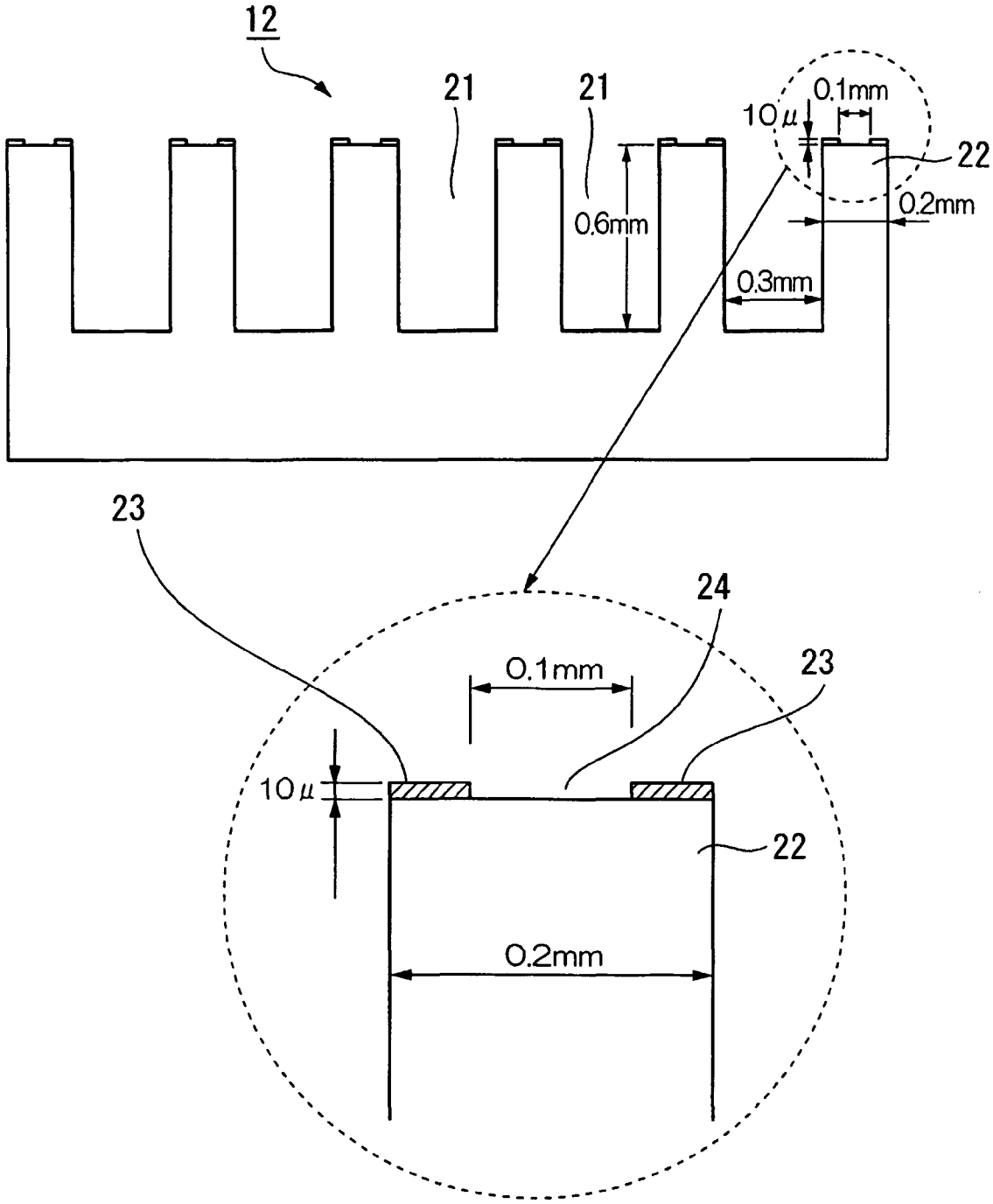
FIG. 5 is a cross-sectional view showing an example of the structure of upper face protrusions on the corrugations of the fixed electrode used in the ultrasonic transducer according to the first embodiment of the present invention.

FIG. 5 is a cross-section view including an enlarged view, showing an example of the structure of upper face protrusions in the corrugations of the fixed electrode 12 of the ultrasonic transducer according to the first embodiment of the present invention.

In FIG. 5, concavities 21 and protrusions 22 are formed in/on the fixed electrode 12. On the top face of the protrusions 22, liquid drops (liquid material such as epoxy resin) are applied by an inkjet method to form banks 23. By means of the banks 23, a groove portion (continuous grooves or holes (cavities)) 24 are formed. By providing the banks 23 and the grooves 24 on the surface of the protrusions 22, adhereing (sticking) of the vibrating film 10 to the fixed electrode 12 can be prevented, so that the efficiency of converting the voltage signal into the sound wave signal can be improved to increase the output sound pressure level.

Furthermore, in the example of the fixed electrode 12 shown in FIG. 5, the concavities 21 have a depth of 0.6 mm and a width of 0.3 mm. The protrusions 22 have a width of 0.2 mm and a height of 0.6 mm. Furthermore, the banks 23 on the surface of the protrusions 22 are formed in parallel at a spacing of 0.1 mm, and the width of the banks 23 is 50 μm, and its height is 10 μm. The height of the banks 23 can be set within a range from 5 μm to 20 μm. The width of the groove portion 24 formed between the banks 23 is 0.1 mm. This width can be set within a range from 0.05 mm to 0.15 mm by changing the formation position of the banks 23.

As the material for the fixed electrode 12 in this case, for example Ni (Nickel), SUS, brass, brass, copper, aluminum or the like may be used. In the case where aluminum is used for the fixed electrode 12, then by subjecting the upper surface of the protrusions 22 to a chrome plating process, so that adhesion with the droplet material can be improved. Furthermore, it is also possible to subject the upper surface of the protrusions 22 to a lyophilic treatment so that adhesion of the droplet material can be improved.

Figure 6:
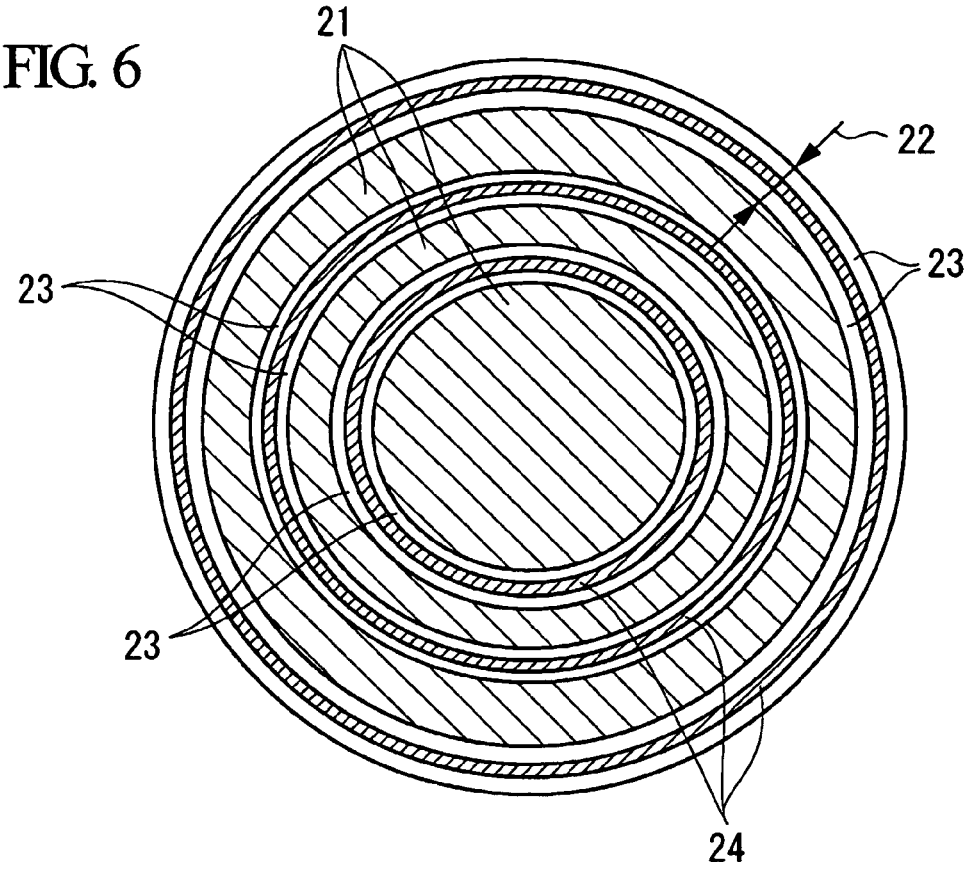
FIG. 6 is a plan view showing an example of the structure of upper face protrusions on the corrugations of the fixed electrode used in the ultrasonic transducer according to the first embodiment of the present invention.

FIG. 6 shows a plan view of the fixed electrode 12, schematically showing the state where concentric banks 23 are formed on the upper surface of the protrusions 22 in the concentric form with locating concentric concavities 21 of 0.3 mm width therebetween. The banks 23 are formed in parallel at a spacing of 0.1 mm width on the protrusions 22 and the groove portions (continuous groove or holes (cavities)) 24 having 0.1 mm width are formed in the top of the protrusions 22 between the concentric banks 23. The depth of the groove portions 24 is 10 μm. This example shows a case where there are three protrusions 22 arranged in concentric, however actually a larger number of protrusions 22 are formed as required.

In the abovementioned embodiment, the groove portions are formed by forming banks 23 on the upper face of the protrusions 22 of the corrugations of the fixed electrode 12. However, groove portions may be formed by electric discharge machining or the like in the upper face of the protrusions 22 of the corrugations of the fixed electrode 12.

Moreover, the groove portions formed on the upper face of the protrusions 22 of the corrugations of the fixed electrode 12 may be formed as isolated or separated grooves, or may be formed in a continuous groove shape. The same effect can be obtained with either. Further, the groove portions may be made as a plurality of circular grooves formed in concentric circles as shown in FIG. 6. Moreover, the groove portions may be made as a plurality of elliptical groove portions formed in concentric ellipses formed on the elliptical protrusions as shown in FIG. 2B.

Furthermore, the groove portions may be formed on the grooves as shown in FIG. 2C as a plurality of straight line groove portions, or as a plurality of free form curved groove portions. The cross-section shape of the groove portions may be made in any one of a rectangular shape, a tapered shape, and with a lower portion of an approximately semicircular shape.

Furthermore, instead of grooves in the upper surface of the protrusions 22 of the corrugations of the fixed electrode, continuously arranged separate holes may be provided as the groove portions. These holes may be formed as cylindrical holes similar to those shown in FIG. 4A, with a plurality arranged continuously in a concentric circle shape or a straight line shape.

Moreover, for the holes, a plurality of conical holes similar to those shown in FIG. 4B may be formed arranged continuously in a concentric circle shape or in a straight line shape.

In this manner, also in the case where continuously arranged holes are provided instead of grooves in the upper surface of the protrusions 22 of the corrugations of the fixed electrode 12, the same effect as for the case where grooves (groove portions) are provided is obtained. Moreover, in the case where continuous holes are provided instead of the grooves, a similar effect can be obtained irrespective of the kind of holes.

Furthermore, for the method of forming the grooves or the holes in the protrusions 22 of the corrugations of the fixed electrode 12 as mentioned above, any method may be used.

The vibrating film 10 will be described next. The function of the vibrating film 10 is to accumulate electric charges of the same polarity (this may be either a positive polarity or a negative polarity) at all times, and to vibrate by the electrostatic force which changes with the AC voltage and acts between the vibrating film and the fixed electrode. A specific configuration example of the vibrating film 10 in the ultrasonic transducer according to the first embodiment of the present invention will be described with reference to FIGS. 7A and 7B.

Figure 7A:
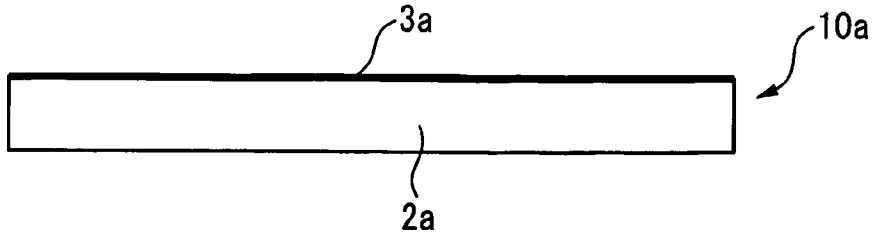
FIGS. 7A and 7B are cross-sectional views showing examples of the structure of a vibrating film used in the ultrasonic transducer according to the first embodiment of the present invention.

FIG. 7A is a cross-sectional view of a vibrating film 10*a* in the case where the vibrating film 10*a* is a one-side electrode-evaporated film. As shown in FIG. 7A, this is formed by vapor depositing an electrode layer 3*a* on the surface of an insulation film 2*a*. The insulation film 2*a* is preferably formed of a polymer material, for example, polyethylene terephthalate (PET), polyester, polyethylene naphthalate (PEN), polyphenylene sulfide (PPS), in view of the flexibility and ability to withstand voltage.

As the electrode-evaporation material forming the electrode layer 3*a*, Al is most commonly used, and Ni, Cu, SUS, Ti other than Al are preferable in view of the compatibility with the polymer material and the cost. The thickness of the nonconductive polymer film serving as the insulation film 2*a* forming the vibrating film 10*a* cannot be uniquely determined, since the optimum value is different based on the drive frequency and the fixed electrode hole size, but generally, a range of from 1 μm to 100 μm inclusive is considered to be sufficient. Preferably, this should be from 1 μm to 50 μm, and more preferably from 1 μm to 20 μm.

It is also desired that the thickness of the electrode-evaporated layer serving as the electrode layer 3*a* be from 40 nm to 200 nm. If the thickness of the electrode-evaporated layer is too thin, the electric charges are hardly accumulated, and if too thick, the film becomes stiff, leading to a problem such that the amplitude decreases.

A transparent conductive film ITO/In, Sn, Zn oxide or the like may be used for the electrode material of the electrode layer 3*a*.

Figure 7B:
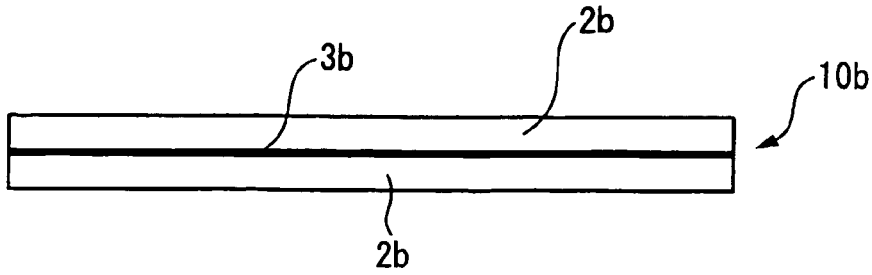

FIG. 7B shows a cross-sectional structure of the vibrating film 10*b* in which the electrode layer 3*b* is placed between insulation films (nonconductive polymer film) 2*b* formed from a polymer material. The thickness of the electrode layer 3*b* in this case is also desired to be in the range of from 40 nm to 200 nm, as in the case of FIG. 7A.

Furthermore, the material of the insulation film 2*b* with the electrode layer 3*b* therebetween is preferably polyethylene terephthalate (PET), polyester, polyethylene naphthalate (PEN), or polyphenylene sulfide (PPS), and the thickness thereof is preferably in the range of from 1 μm to 100 μm inclusive, as in the one-side electrode-evaporated film in FIG. 7A. Preferably, this should be from 1 μm to 50 μm, and more preferably from 1 μm to 20 μm. In this case also, as the electrode material, Al is most commonly used, and Ni, Cu, SUS, Ti other than Al are preferable in view of the compatibility with the polymer material and the cost. A transparent conductive film ITO/In, Sn, Zn oxide or the like may be used for the electrode material.

Moreover, the vibrating film 10 or the fixed electrode 12 requires a DC bias voltage of several hundred volts, but the DC bias voltage can be reduced by fixing the vibrating film 10 by applying tension in four right-angle directions on the film plane of the vibrating film 10 at the time of preparing the film unit. This is because by applying tension to the film beforehand, the restoring force of the film caused by the tension produces the same effect as the tension borne by the conventional bias voltage, and this is a very effective means to decrease the voltage.

As the material for fixing the fixed electrode or the vibrating film, a synthetic resin material such as acrylic, bakelite, polyacetal (polyoxymethylene) resin (POM) and the like is preferable from the point of light weight and nonconductivity.

Figure 8A:
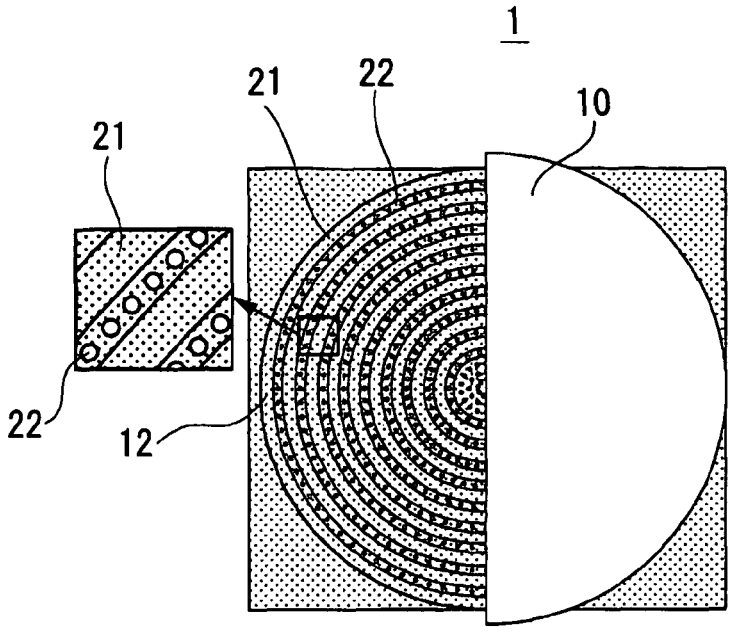
FIGS. 8A and 8B are a plan view and a cross-sectional view, respectively, showing an example of the ultrasonic transducer according to the first embodiment of the present invention.
Figure 8B:
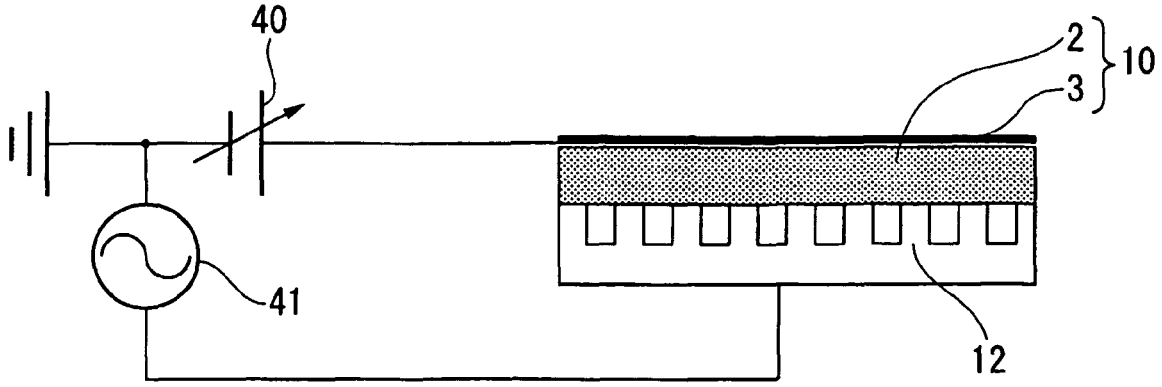

Next, a specific example of the electrode structure of the ultrasonic transducer 1 according to the first embodiment of the present invention is shown in FIGS. 8A and 8B. FIG. 8A shows a partial cut-away plan view of the ultrasonic transducer 1, and FIG. 8B shows a schematic structure of the ultrasonic transducer 1.

In FIGS. 8A and 8B, the fixed electrode 12 of the ultrasonic transducer 1 has holes of 100 μm diameter and 10 μm depth provided in concentric circles by nickel plating on a copper sheet to form the concentric protrusions 22. After that, 98 grooves of 0.3 mm wide and 0.6 mm deep are made in concentric circles between the concentric protrusions 22 by electric discharge machining so as to form the concentric concavities 21. The material of the insulation film 2 which constitutes the vibrating film 10 is made from PET at a thickness of 6 μm, and the electrode layer 3 is produced by vacuum evaporation of an aluminum film of a thickness of 50 nm.

The ultrasonic transducer 1 of this construction is applied with a DC bias voltage of 125 V from a DC bias supply 40 to the electrode layer 3 of the vibrating film 10, and applied with an AC voltage of 150 Vp-p between the electrode layer 3 of the vibrating film 10 and the fixed electrode 12 from a signal source 41, to thereby drive.

Figure 9:
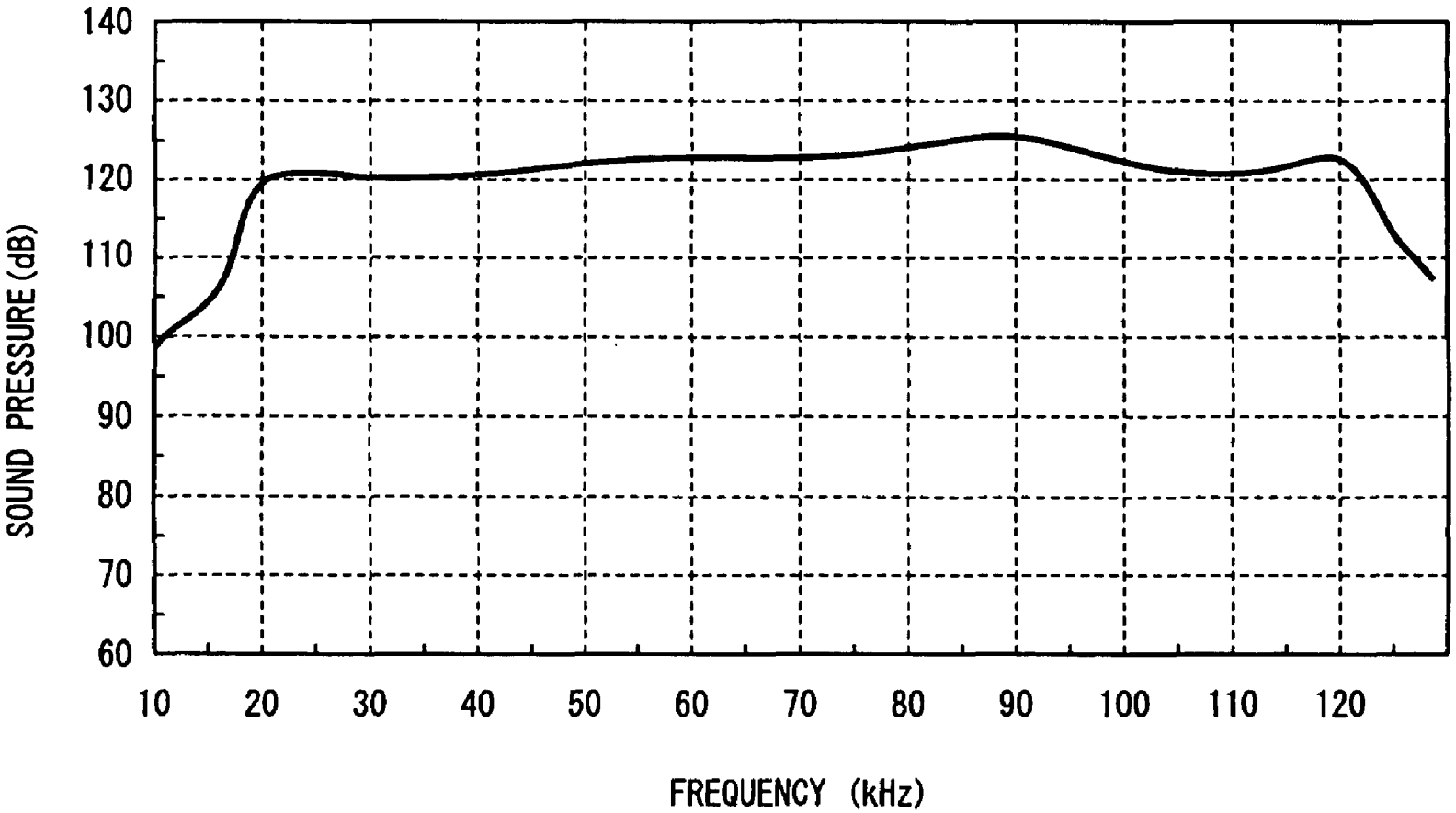
FIG. 9 is a diagram showing the frequency characteristic of the ultrasonic transducer shown in FIG. 8.

The frequency characteristics are shown in FIG. 9. As shown in FIG. 9, it is seen that a high sound pressure of 120 dB or more is realized across a wide band from 20 kHz to 120 kHz with a fluctuation of less than ±3 dB.

Generally, the working force between the electrodes of a parallel plate capacitor is expressed by the following equation.

$$F=\in/2\cdot(V/d)^2\cdot S \quad (1)$$

where F is the attraction force, ∈ is the dielectric constant, V is the applied voltage between the electrodes, d is the distance between electrodes, and S is the electrode surface area.

As is seen from equation (1), the attraction force is proportional to the square of the applied voltage between the electrodes, and the electrode surface area. This is because the charge accumulated in the electrode layer of the vibrating film increases with the increase in the applied voltage between the electrodes, or the increase in the area of the electrode surface due to providing corrugations in the fixed electrode.

Next, an ultrasonic transducer 70 according to a second embodiment of the present invention will be described in reference to FIG. 10. The difference in the structure of the ultrasonic transducer 70 according the second embodiment of the present invention to that of the ultrasonic transducer 1 according to the first embodiment is only in the electrode structure. Other construction is the same and hence repeated description is omitted.

Figure 10:
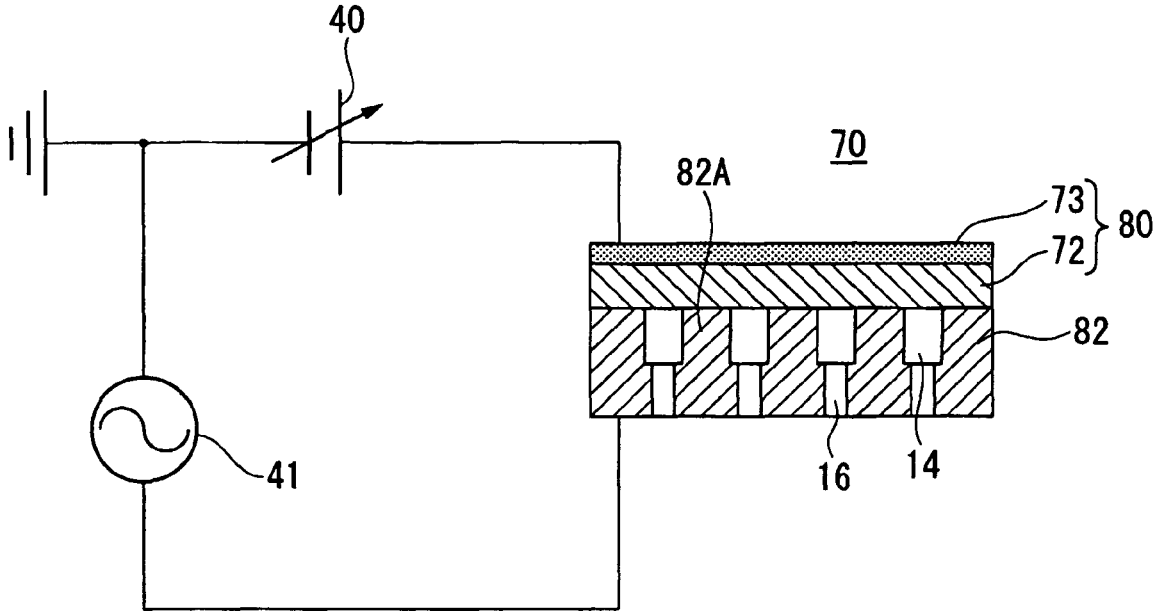
FIG. 10 is a cross-sectional view showing an ultrasonic transducer according to a second embodiment of the present invention.

In FIG. 10, the ultrasonic transducer 70 includes an upper electrode 80 having a vibrating film 72 formed from an insulating material, and an electrode film 73 formed on top of the vibrating film 72. A fixed, lower electrode 82 is formed with a plurality of corrugations on the face facing the vibrating film 72 of the upper electrode 80. A DC bias supply 40 is connected to the electrode film 73 of the upper electrode 80 while a signal source 41 is connected to the lower electrode 82 and the electrode film 73.

A constant DC bias voltage is applied between the upper electrode 80 and the lower electrode 82 at all times by the voltage adjustable DC bias supply 40, so that the upper electrode 80 is attracted to the protruding portion 82A of the lower electrode 82 by the electrostatic force generated by the electric field, and is stuck except for at the cavities 14 formed in the lower electrode 82.

Through holes 16 which lead from the cavities 14 to the outside, are formed in the lower electrode 82.

An AC signal being the signal voltage (with a frequency in the ultrasonic frequency band of above 20 kHz), is applied from the signal source 41 to between the upper electrode 80 and the lower electrode 82, in a condition superimposed on the DC bias voltage from the DC bias supply 40.

The through holes 16 function as a compression resistance reduction means for reducing the compression resistance of the air which occurs in the cavities 14 when the vibrating film 72 vibrates.

In the above configuration, when the DC bias voltage is applied from the DC bias supply 40 to between the electrode layer 73 of the upper electrode 80, and the lower electrode 82, the protruding portion 82A of the lower electrode 82 attracts the upper electrode 80. In this condition, the AC signal from the signal source 41 is applied superimposed on the DC bias voltage, to between the electrode layer 73 of the upper electrode 80, and the lower electrode 82, so that the vibrating film 72 of the upper electrode 80 is driven by the AC signal and vibrates.

At this time, a pressure corresponding to the vibration of the vibrating film 72 is added to the air inside the cavities 14. However, since this air flows smoothly via the through holes 16 which are communicated with the outside, then a greater vibration (amplitude) is obtained in the vibrating film 72.

Figure 12A:
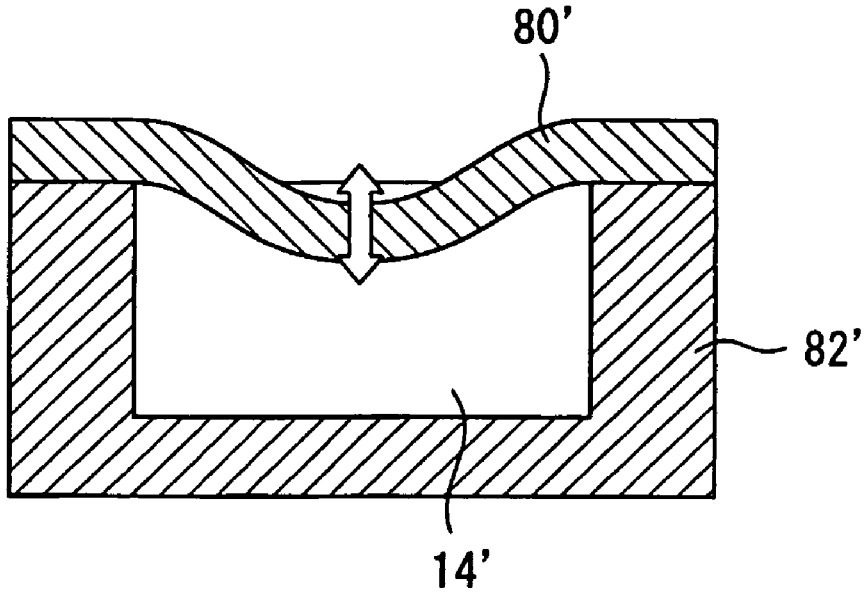
FIGS. 12A and 12B are cross-sectional views showing the operation of a conventional ultrasonic transducer and the operation of the ultrasonic transducer according to the second embodiment of the present invention, respectively.
Figure 12B:
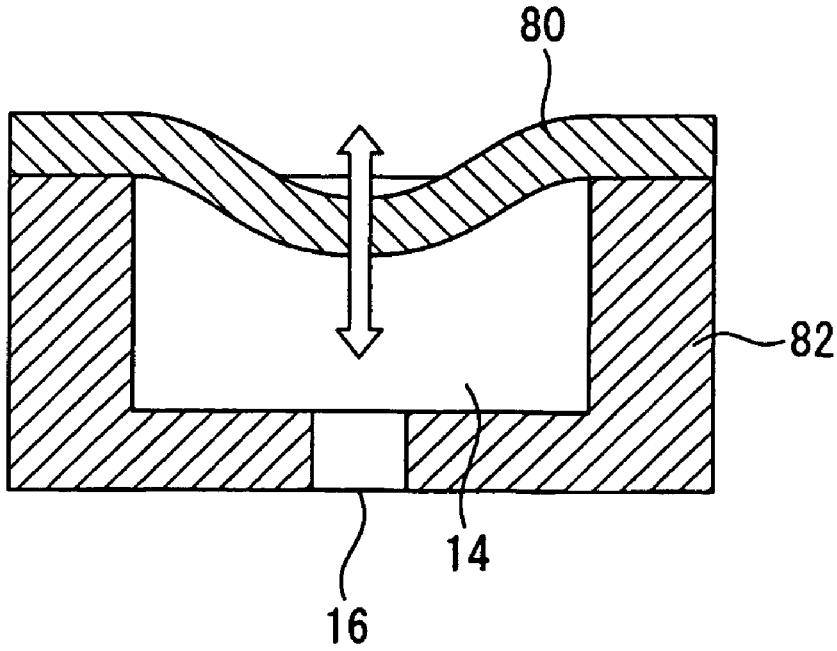

FIGS. 12A and 12B schematically show the state under operating a conventional ultrasonic transducer and the ultrasonic transducer according to the second embodiment of the present invention, respectively. In the figures, only one cavity formed between the upper electrode and the lower electrode for the ultrasonic transducer is shown for simplification.

As shown in FIG. I 12A, in the conventional electrostatic ultrasonic transducer at the time of operation, the space inside the cavities 14 acts as a damper (spring). Therefore the amplitude of the film vibration of the upper electrode 80' is small. On the other hand, in the ultrasonic transducer according to the second embodiment of the present invention, the through holes 16 which communicate to the outside from the cavities 14 are provided in the lower electrode 82. Therefore when the vibrating film of the upper electrode 80 vibrates, the flow of air inside the cavities 14 is smooth, so that the amplitude of the film vibration is larger.

Figure 11A:
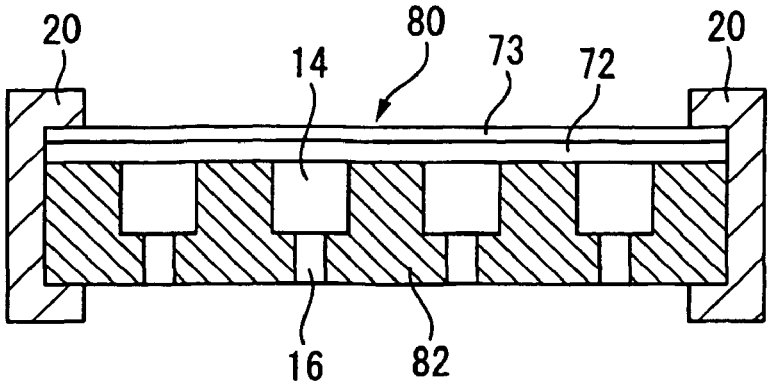
FIGS. 11A, 11B and 11C are cross-sectional views showing examples of the electrode construction used in the ultrasonic transducer according to the second embodiment of the present invention shown in FIG. 10.
Figure 11B:
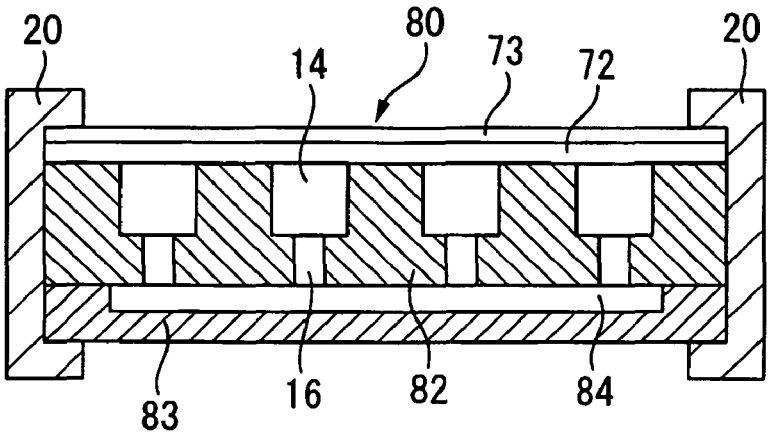
Figure 11C:
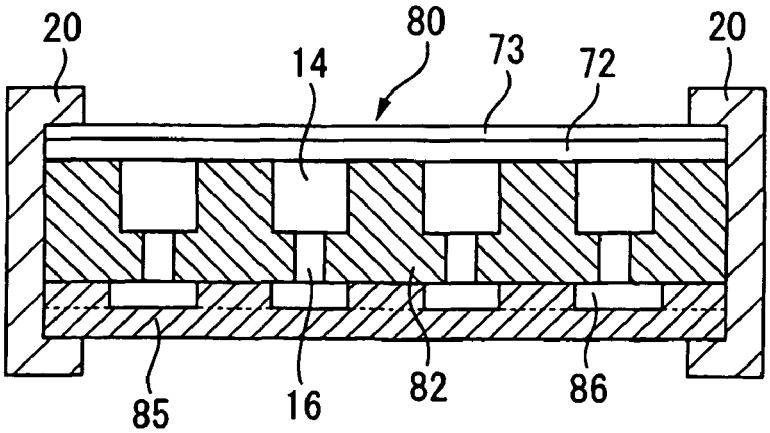

Some examples of the cross-sectional structure of the ultrasonic transducer 70 according to the second embodiment are shown in FIGS. 11A to 11C.

As shown in FIG. 11A, the upper electrode 80 and the lower electrode 82 shown in FIG. 10 are clamped together by a holding member or a case 20.

In the cross-section structure of the ultrasonic transducer according to the second embodiment, a construction is possible where the lower electrode 82 is fixed onto a base plate 83 as shown in FIG. 11B, and all of the through holes 14 provided in the lower electrode 82 are communicated with a concavity 84 provided in the base plate 83 which communicates with the outside.

In the alternative structure shown in FIG. 11C, the lower electrode 82 is fixed onto a base plate 85, and each of the plurality of through holes 14 provided in the fixed electrode 82 are communicated with passages 86 provided in the base plate 85 immediately beneath the respective through holes 14, and which communicate with the outside.

Next, an ultrasonic transducer according to a third embodiment of the present invention will be described hereinafter in reference to FIG. 13. The difference in the structure of the ultrasonic transducer according to the third embodiment of the present invention to that of the ultrasonic transducer according to the first and second embodiments is that a cone is provided on the back face of the upper electrodes. Other construction is similar or the same and, hence, repeated description is omitted.

Figure 13:
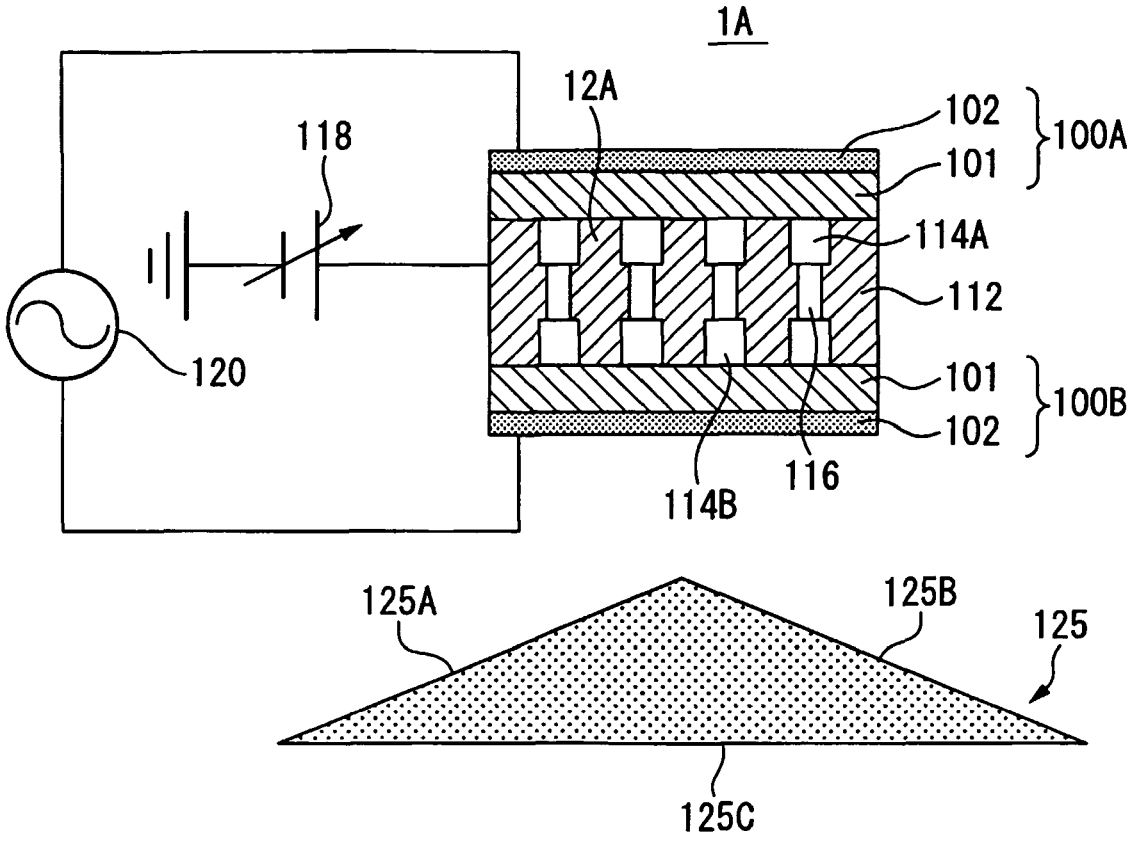
FIG. 13 is a cross-sectional view showing an ultrasonic transducer according to a third embodiment of the present invention.

In FIG. 13, the ultrasonic transducer 1A according to the third embodiment comprises a fixed electrode 112 formed with a plurality of concavities 114A and 114B on both upper and lower faces, and upper and lower electrodes 100A and 100B each including a vibrating film 101 formed from an insulating material which are arranged respectively facing opposite sides of the fixed electrode 112 and a conductive film 102 which is formed on the vibrating film 101. A DC bias supply 118 is connected to the fixed electrode 112 while a signal source 120 is connected to the upper and lower electrodes. A cone 125 is provided at a position facing one of the upper and lower electrodes 100A and 100B, for example facing the lower electrode 100B.

By sticking the upper and lower electrodes 100A and 100B to the fixed electrode 112, a plurality of cavities 114A (in the upper side of the fixed electrode 112) and 114B (in the lower side of the fixed electrode 112) are formed.

For the cavities 114A and 114B formed in the upper and lower sides of the lower electrode 112, through holes 116 which respectively communicate between the cavities 114A and the cavities 114B are formed in the fixed electrode 112.

A constant DC bias voltage is applied to the fixed electrode 112 by the voltage adjustable DC bias supply 118.

Furthermore, an AC signal (with a frequency of over 20 kHz in the ultrasonic frequency band) as the signal voltage, is applied between the upper and lower electrodes 100A and 100B from the signal source 120.

The cone 125 provided at a position facing the lower electrode 100B has a function of reflecting the ultrasonic waves produced downwards in the figure, in the upwards direction by reflection surfaces 125A and 125B. In the arrangement of the cone 125 in this embodiment, the cone 125 functions so as to emanate the ultrasonic waves produced in the downward direction. However, in the case where the reflection surface 125C of the cone 125 is arranged so as to face the lower electrode 100B, the cone 125 functions so as to focus the ultrasonic waves produced in the downward direction towards the same direction.

The material of the cone 125 is preferably a material for which the difference in the acoustic impedance to the air is large, for example a hard solid (metal, ceramic, synthetic resin) or the like.

In the above construction, in a condition with a constant DC bias voltage applied to the fixed electrode 112 from the DC bias supply 118, an AC signal from the signal source 120 is applied between the upper and lower electrodes 100A and 100B, so that a conducting films 102 of the upper and lower electrodes 100A and 100B are driven and vibrates. At this time, when applying an AC voltage of a positive polarity to the conducting film 102 of the upper electrode 100A, an AC voltage of a negative polarity is applied to the conducting film 102 of the lower electrode 100B. In this case, since the positive DC bias voltage is applied to the fixed electrode 112, the vibrating film 101 of the upper electrode 100A which is positioned facing the cavity 114A formed in the upper end of the fixed electrode 112 is subjected to a repulsion force from the fixed electrode 112, and is displaced upwards in the figure.

Moreover, at this time, the vibrating film 101 of the lower electrode 100B which is positioned facing the cavity 114B formed in the lower end of the fixed electrode 112 is subjected to an attraction force from the fixed electrode 112, and is displaced upwards in the figure.

Similarly, when applying an AC voltage of a negative polarity to the conducting film 102 of the upper electrode 100A, an AC voltage of a positive polarity is applied to the conducting film 102 of the lower electrode 100B. In this case, since the positive DC bias voltage is applied to the fixed electrode 112, the vibrating film 101 of the upper electrode 100A which is positioned facing the cavity 114A formed in the upper end of the fixed electrode 112 is subjected to an attraction force from the fixed electrode 112, and is displaced downwards in the figure.

Moreover, at this time, the vibrating film 101 of the lower electrode 100B which is positioned facing the cavity 114B formed in the lower end of the fixed electrode 112 is subjected to a repulsion force from the fixed electrode 112, and is displaced downwards in the figure.

In this manner, the conducting films 102 of the upper and lower electrodes 100A and 100B are displaced in both directions so that when an AC signal from the signal source 120 is applied between the conducting films 102 of the upper and lower electrodes 100A and 100B, then in the case where the vibrating film 101 of the upper electrode 100A is displaced upwards corresponding to the polarity of the applied AC signal, the vibrating film 101 of the lower electrode 100B is also displaced upwards, while in the case where the vibrating film 101 of the upper electrode 100A is displaced downwards, the vibrating film 101 of the lower electrode 100B is also displaced downwards.

Therefore, the air trapped inside the cavity 114A and the cavity 114B moves via the through holes 116 so that the volume change of the air trapped in the cavities 114A and 114B can be controlled. Hence the spring effect due to the coefficient of cubic expansion of the air is reduced, and a larger film vibration is obtained.

Figure 14A:
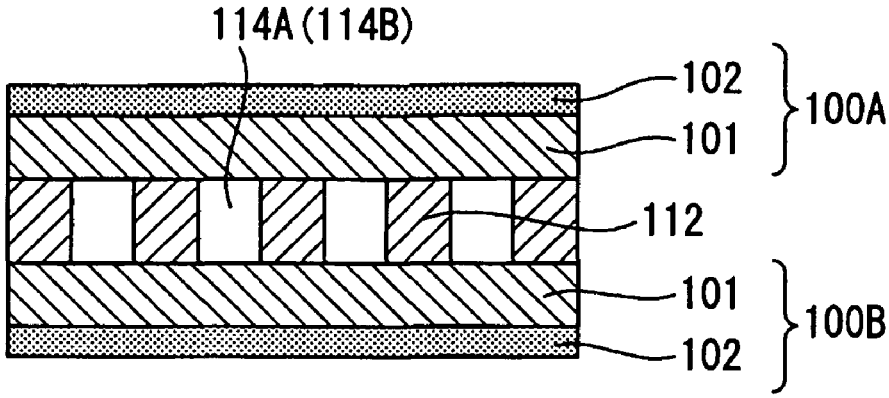
FIGS. 14A and 14B are cross-sectional views showing a fixing process for the upper electrode and the lower electrode used in the ultrasonic transducer according to the third embodiment of the present invention.
Figure 14B:
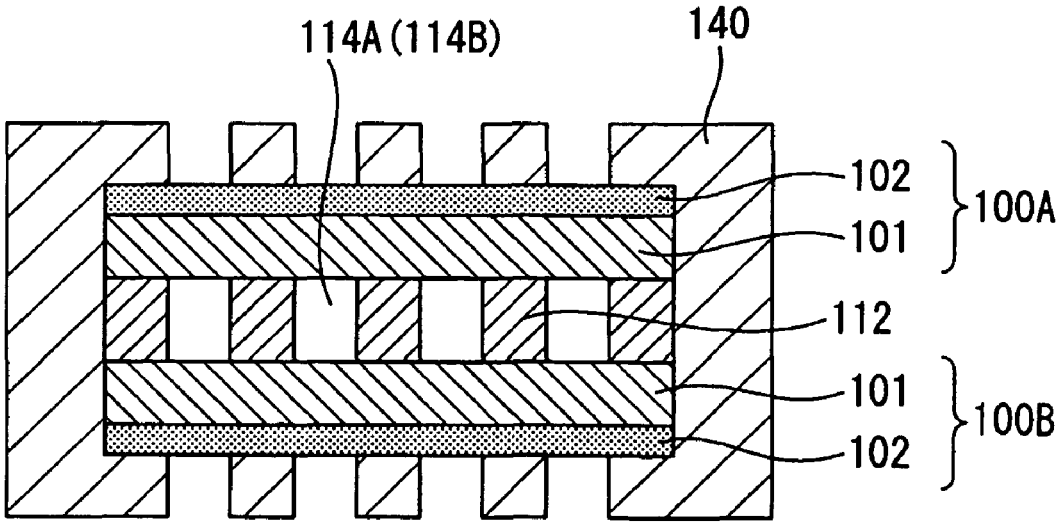

FIGS. 14A and 14B show a fixing method for the upper and lower electrode 100A and 100B and the fixed electrode 112 of the ultrasonic transducer according to the third embodiment. As described above with reference to FIG. 13, in the ultrasonic transducer, the vibrating films 101 of the upper and lower electrodes 100A and 100B are alternately subjected to a force in both the up and down directions corresponding to the polarity of the AC signal. Therefore, they are not always attracted to the fixed electrode 112. Consequently, an appropriate fixing method is necessary to always make contact the vibrating films 101 with the fixed electrode 112 against the electrostatic attraction force. Here, in FIGS. 14A and 14B, the electrode structure is shown simplified, however, this is the same as the electrode structure, including the structure of the cavities, of the ultrasonic transducer shown in FIG. 13.

The fixing method for the upper electrode and the lower electrode shown in FIG. 14A is one where the contact faces of the upper and lower electrodes 100A and 100B, and the fixed electrode 112 in the ultrasonic transducer 1A are fixed by bonding.

The fixing method for the upper electrode and the lower electrode shown in FIG. 14B illustrates a method of fixing the upper and lower electrodes 100A and 100B to the fixed electrode 112 with a member 140 of a shape such as a mesh shape, which corresponds to (is identical to) the shape of the cavities 114A and 114B in the fixed electrode 112. Preferably the material for the mesh is a material such as a fiber or a plastic which has been subjected to processing for making it flexible and smooth so as not to damage the electrodes.

By fixing the upper and lower electrodes 100A and 100B to the fixed electrode 112 by the method shown in FIGS. 14A and 14B, the DC bias voltage for attracting the upper and lower electrodes 100A and 100B to the lower electrode 112 can be made unnecessary.

The frequency characteristics of the ultrasonic transducer according to the second embodiment and the third embodiment are as shown by the curve Q3 in FIG. 19, showing a large sound pressure level to be constant over a wide frequency band.

As described above, according to the ultrasonic transducer according to the second embodiment of the present invention, the though holes which communicate to the outside from the interior of the plurality of cavities formed between the upper and lower electrodes by bonding the upper electrode to the fixed, lower electrode, are provided in the fixed, lower electrode. Therefore, when the vibrating film vibrates, the flow of air is smooth, so that the amplitude of the vibrating film can be made larger.

Furthermore, according to the ultrasonic transducer according to the third embodiment of the present invention, the vibrating films constituting the upper and lower electrodes are provided on both faces of the fixed electrode, and of the cavities formed in the upper and lower ends of the fixed electrode, through holes are formed which communicate between each of the cavities formed in the upper end, and the cavities formed directly below in the lower end of the fixed electrode. Therefore the vibrating films of the upper and lower electrodes are displaced in both directions corresponding to the polarity of the AC signal applied between the upper and lower electrodes, so that the volume change of the air trapped in the cavities formed in the upper and lower ends of the fixed electrode can be controlled. Hence the spring effect due to the coefficient of cubic expansion of the air is reduced, and a larger film vibration is obtained Moreover, according to the ultrasonic transducer according to the third embodiment, since the contact faces of the upper and lower electrodes and the fixed electrode are fixed by bonding, the DC bias voltage for attracting the contact faces of the upper and lower electrodes and the fixed electrode can be reduced, so that miniaturization of the power unit which has heretofore been a large size is achieved.

Furthermore, according the ultrasonic transducer according to the third embodiment, since there is provided with the pressing device for pressing and fixing the contact faces of the upper and lower electrodes and the fixed electrode, the DC bias voltage for attracting the contact faces of the upper and lower electrodes and the fixed electrode can be reduced, so that miniaturization of the power unit which has heretofore been a large size is achieved.

Moreover, according to the ultrasonic transducer according to the third embodiment, since a constant DC bias voltage is applied to the fixed electrode, and an AC signal voltage is applied between the upper and lower electrodes which are arranged at the top and bottom ends of the fixed electrode, the vibrating films of the upper and lower electrodes which are disposed at the upper and lower ends of the fixed electrode, can be efficiently vibrated.

Furthermore, according to the ultrasonic transducer according to the third embodiment, since there is provided with the cone at a position facing either one of the upper and lower electrodes, which emanates or focuses the sound waves towards the front, the ultrasonic output produced by the vibration of the vibrating film constituting the upper and lower electrodes can be effectively utilized.

Figure 15A:
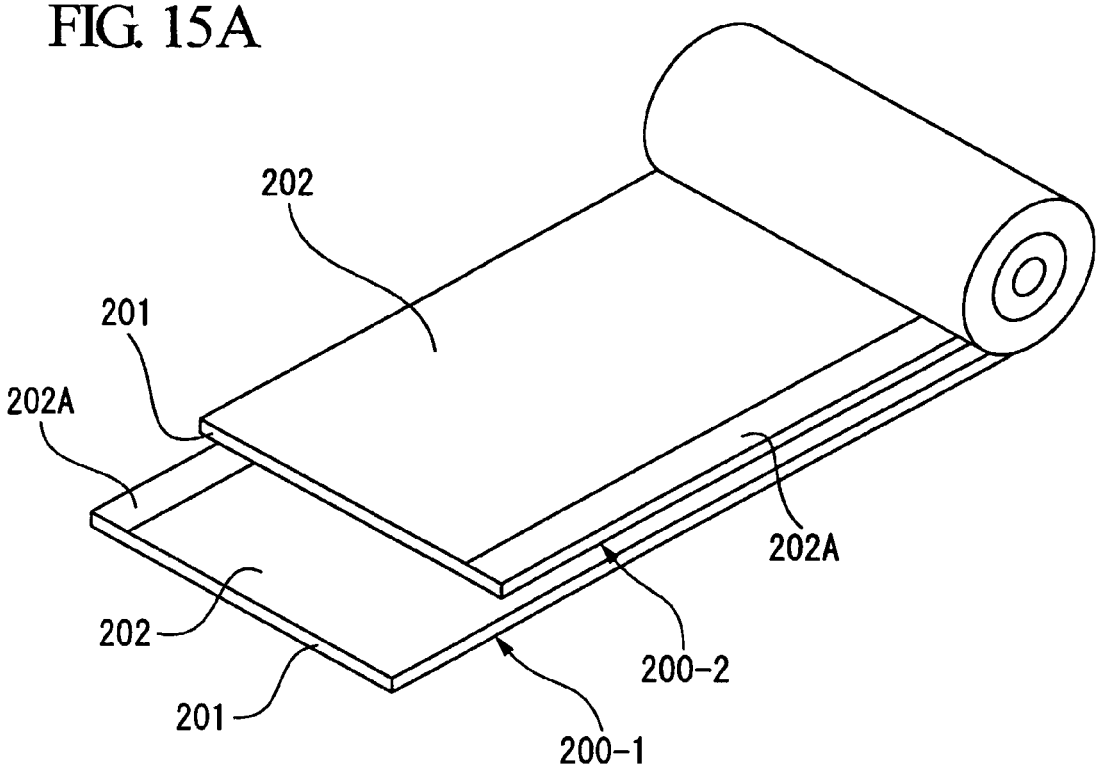
FIGS. 15A and 15B are a perspective view and a cross-sectional view showing the electrode structure used in an ultrasonic transducer according to a fourth embodiment of the present invention.
Figure 15B:
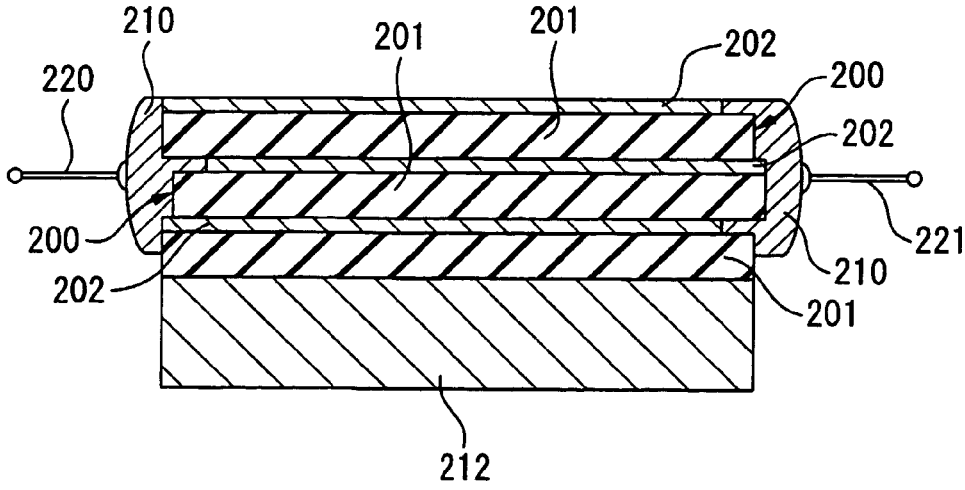

Next, the electrode structure of an ultrasonic transducer according to a fourth embodiment of the present invention is shown in FIGS. 15A and 15B. The difference in the structure of the ultrasonic transducer according to the fourth embodiment of the present invention, to that of the first and second embodiments is only in the electrode structure. Other construction is the same and hence repeated description is omitted.

In the electrode structure of the ultrasonic transducer according to the fourth embodiment, the upper electrode, as shown in FIG. 1SA, has a multilayer structure. That is, on top of an upper electrode portion 200-1 with a conducting film 202 (deposition portion) formed on an upper face of a vibrating film 201, is laminated an upper electrode portion 200-2 of the same construction.

Here, at one edge of the upper electrode portion 200-1, a margin section 202A where the conducting film is not deposited is formed. On the upper electrode portion 200-2 which is laminated on the upper electrode portion 200-1, a margin portion 202A is formed at the edge on the opposite side to the margin portion 202A of the upper electrode portion 200-1.

FIG. 15A shows, for convenience of explanation, the state where the upper electrode portion is laminated in two layers. However, actually, as shown in FIG. 15B, the upper electrode is constructed by laminating a plurality of two or more upper electrode portions.

As shown in FIGS. 15A and 15B, the mask portions (the non-electrode deposition portions) 202A are provided different to each other, so that the overlapping electrodes (conducting film) are not short circuited. Furthermore, this construction simplifies taking the electrodes to the outside.

In FIG. 15B, compared to the fixed, lower electrode 212, the upper electrode which is formed by laminating the upper electrode portion, is shown comparatively thick. However, this is only so that the electrode construction can be more clearly explained, and actually the upper electrode is formed much thinner than the fixed, lower electrode 212.

Moreover, in order to force the upper electrode to the fixed, lower electrode side, a tension is applied, for example by the holding member or the case. If a tension is not applied, the upper electrode is not stuck tight, and hence the vibration behavior of the upper electrode becomes unstable which is not desirable. In the case where there is a tension, then due to the force, the laminated upper electrodes (vibrating films) vibrate essentially as one vibrating member.

On the stuck of the upper electrode portions 200-1 and 200-2, a connecting portion 210 is formed by spraying a product called metalicon metal. By connecting a lead wire to the connecting portion 210 to engage to an external power source or the like.

Metalicon is a gas flame coating method which uses an oxyacetylene flame or an electric welding method using electric arc heating, in a method for blow coating a molten metal such as tin, zinc, aluminum, copper, brass, gold, silver, nickel silver, nickel, iron etc. or an alloy of these. Metalicon can also be applied to materials other than metal such porcelain, glass, wood, and the like.

In the electrode structure of the ultrasonic transducer according to the fourth embodiment of the present invention constructed as described above, capacitors are formed from the electrode films of the upper electrodes, and the fixed, lower electrode. At this time, the force acting between electrodes is expressed by the following equation.

$$F=\in/2\cdot(V/d)^2\cdot S \quad (1)$$

where F is the attraction force, E is the dielectric constant, V is the applied voltage between the electrodes, d is the distance between electrodes, and S is the electrode surface area.

As is seen from the above equation (1), the attraction force F is proportional to the electrode surface area. This is because the charge accumulated in the surface electrode is increased in proportion to the area.

Consequently, by making the upper electrode a laminated structure as with the electrode structure of the ultrasonic transducer according to the fourth embodiment of the present invention, the electrode area of the upper electrode, that is the conducting film, can be substantially increased so that the electric charge which is accumulated can be increased. As a result, the attraction force acting on the upper electrode can be increased, and hence the film displacement of the vibrating film can be increased, and the sound pressure increased. The frequency characteristics of the sound pressure level of the ultrasonic transducer in this case is shown by the curve Q3 in FIG. 19.

Figure 16:
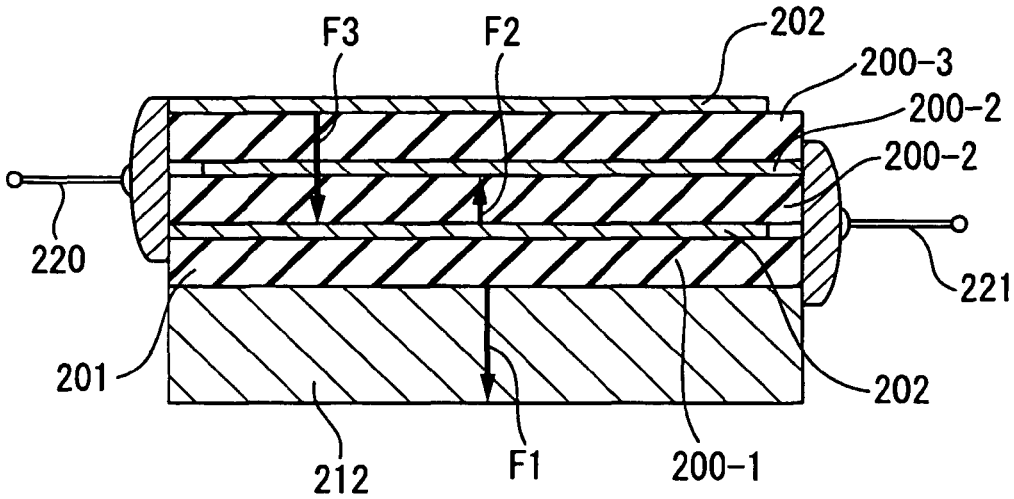
FIG. 16 is a cross-sectional view showing an example of the electrode structure used in the ultrasonic transducer according to the fourth embodiment of the present invention.

Next, FIG. 16 shows a specific example of the electrode structure of the ultrasonic transducer according to the fourth embodiment of the present invention. In FIG. 16, the thickness of the first upper electrode portion 200-1 and the third upper electrode portion 200-3 is d/4, and the thickness of the second upper electrode portion 200-2 is 2d/4, so that the total thickness of the upper electrode is d. In the case where the upper electrode is constructed with one layer of film of thickness d, the electrostatic force F which acts on the upper electrode is expressed by equation (1).

However, in the example shown in FIG. 16, the conducting film 202 of the second upper electrode portion 200-2 is short circuited with the fixed, lower electrode 212. Therefore the total of the electrostatic force (attraction force) F1 and F2 which acts on the conducting film 202 of the first upper electrode portion 200-1, and the electrostatic force (attraction force) F3 which acts on the conducting film 202 of the third upper electrode portion 200-3, becomes the electrostatic force which acts on the conducting film 202 of the upper electrode with respect to the lower electrode 212. Since the actual electrostatic force is basically only an attraction force, then in this embodiment shown in FIG. 16, the working force on the electric charge which is accumulated in the conducting film 202 is shown by the arrows.

In this case, taking the electrostatic force F of equation (1) as a reference, then F1=F3=16 F, and F2=−4 F, and the electrostatic force acting on the electrode film of the upper electrode is the total, being 16 F+16 F−4 F=28 F, which is much greater than the case where the upper electrode is formed in one layer with a film of thickness d.

The important thing here is that provided the first and the third upper electrode portions of the upper electrode are a thickness which can maintain the electrical endurance (can withstand the voltage) and are mechanically durable (against vibration destruction), then these are preferably as thin as possible. Furthermore, the total thickness of the conducting films on the upper electrode is 10 μm in this embodiment, but preferably is as thin as possible.

In the example shown in FIG. 16, a necessary condition is that the thickness of the vibrating films 201 of the first and the third upper electrode portions is thinner than the thickness of the vibrating film 201 of the second upper electrode portion. Furthermore, in the case where a five layer structure is adopted, it is important that the vibrating films 201 of the first, the third and the fifth upper electrode portions (the conducting film 202 formed on each layer has the same potential) are thinner than the vibrating films 201 of the second and the fourth upper electrode portions (the conducting film 202 formed on each layer has the same potential as the lower electrode). This is in order to make the attraction force acting on the conducting film of the upper electrode large. This is apparent from the relationship of the electrostatic force shown in FIG. 16 derived from equation (1), that is, the magnitude and direction of the forces acting on the conducting film of each layer.

According to the ultrasonic transducer according to the fourth embodiment of the present invention, this is an ultrasonic transducer having: the upper electrode comprising the vibrating film formed from the insulating material, and the conducting film formed on the vibrating film; and the lower electrode formed with a plurality of corrugations on the surface facing the vibrating film of the upper electrode, and which generates an ultrasonic wave by sticking the upper electrode to the lower electrode, and applying an AC signal between the upper electrode and the lower electrode. Since, the upper electrode is formed as a laminated structure, the attraction force acting on the upper electrode can be increased. Therefore the amplitude of the vibrating film when vibrating can be enlarged, and a decrease in the DC bias voltage and the AC signal voltage is achieved.

In the ultrasonic transducer according to the second through fourth embodiments, the upper face of the protrusions of the corrugations of the fixed electrode are provided with grooves or with holes arranged continuously, as with the ultrasonic transducer according to the first embodiment. As a result, attraction (sticking) of the vibrating film (the upper electrode) to the fixed electrode can be prevented, and the efficiency of converting the electric signal into the acoustic signal can be increased, and the output sound pressure level can be increased.

Moreover, the capacitance of the parallel capacitor formed between the vibrating film and the fixed electrode is reduced, so that the driving current of the ultrasonic transducer can be reduced.

Figure 17:
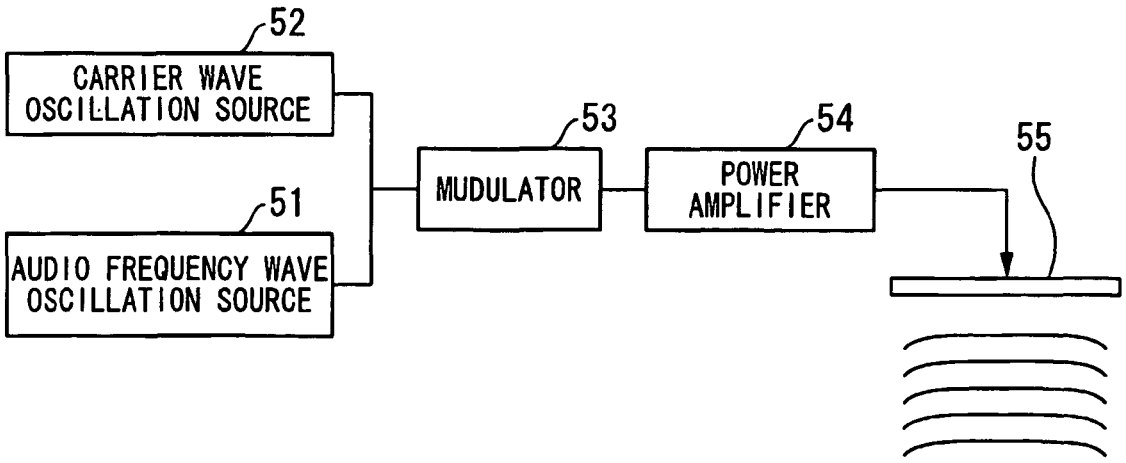
FIG. 17 is a block diagram showing an ultrasonic speaker according to an embodiment of the present invention.
Figure 18:
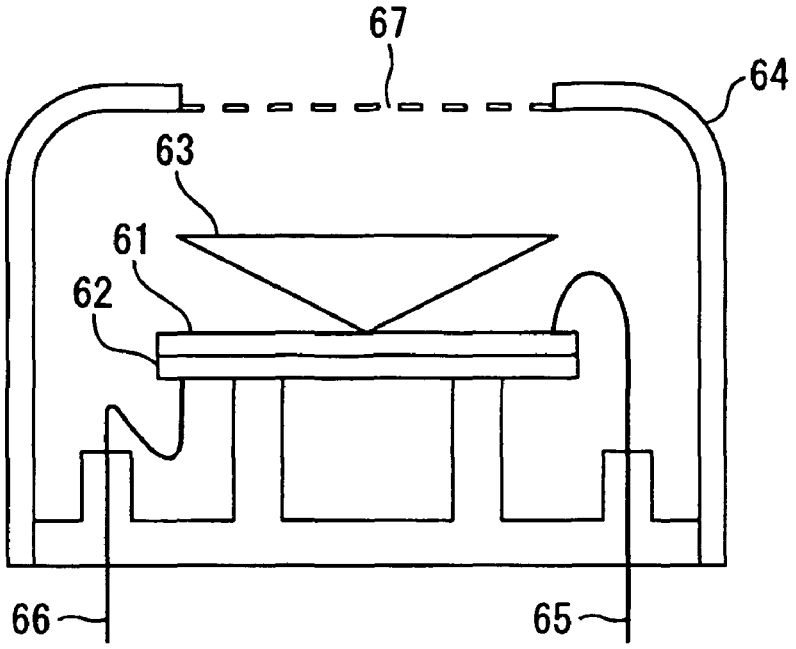
FIG. 18 is a cross-sectional view showing a conventional resonant ultrasonic transducer.

Next, an ultrasonic speaker according to an embodiment is shown in FIG. 17. In the ultrasonic speaker according to the embodiment, any one of the ultrasonic transducers according to the aforementioned embodiments of the present invention is used as an ultrasonic transducer 55.

In FIG. 17, the ultrasonic speaker according to the embodiment comprises an audio frequency wave oscillation source (signal source) 51 which generates signal waves in an audio frequency band, a carrier wave oscillation source (carrier wave supply unit) 52 which generates and outputs carrier waves in an ultrasonic frequency band, a modulator (modulating unit) 53, a power amplifier 54, and the ultrasonic transducer 55.

The modulator 53 modulates the carrier waves output from the carrier wave oscillation source 52 with signal waves in the audio frequency band output from the audio frequency wave oscillation source 51, and supplies the carrier waves to the ultrasonic transducer 55 via the power amplifier 54.

In the above configuration, the carrier wave in the ultrasonic frequency band output from the carrier wave oscillation source 52 is modulated by the modulator 53 with the signal waves output from the audio frequency wave oscillation source 51, to drive the ultrasonic transducer 55 by the modulated signal amplified by the power amplifier 54. As a result, the modulated signal is converted to sound waves of a finite amplitude level by the ultrasonic transducer 55, and the sound waves are radiated into the medium (air), and the original signal sound in the audio frequency band is self-reproduced by the nonlinear effect of the medium (air).

In other words, since the sound waves are compression waves that propagate through the air as a medium, dense parts and sparse parts of the air appear remarkably in a process of propagation of the modulated ultrasonic waves. Since the speed of sound is fast in the dense parts, and is slow in the sparse parts, a distortion occurs in the modulated wave itself. As a result, the waveform is separated into carrier waves (ultrasonic frequency band) and audio waves, to reproduce the signal waves (signal sound) in the audio frequency band.

If the broadband property at a high sound pressure can be ensured, various applications of the speaker become possible. Ultrasonic waves attenuate sharply in the air, and attenuate in proportion to the square of the frequency. Therefore, when the carrier frequency (ultrasonic waves) is low, attenuation decreases, thereby realizing a speaker that can make sound reach a long way in the form of beams.

In contrast, if the carrier frequency is high, attenuation is sharp, and hence, the parametric array effect is not sufficient, thereby providing a speaker that can expand the sound. With the same ultrasonic speaker, these features can be used according to the application, which is a very effective function.

Moreover, dogs and cats sharing life with humans as pets can hear sound up to 40 kHz in the case of dog, and up to 100 kHz in the case of cat. Hence, if a carrier frequency not lower than 100 kHz is used, pets are not affected. Application at various frequencies brings many merits.

According to the ultrasonic speaker according to the embodiment of the present invention, this is constructed using the ultrasonic transducer according to the embodiments of the present invention, which can generate an acoustic signal of a sound pressure level sufficiently high for obtaining the parametric array effect over a wide frequency band (20 kHz to 120 kHz). As a result, a signal sound (audio frequency band) can be reproduced with high fidelity over a wide frequency band.

Moreover, in the case where the ultrasonic transducer according to the embodiments of the present invention, is used as a broadband ultrasonic speaker, since this is broadband, various carrier frequencies can be used, so that control such as for the sound spread or the sound range can be performed.

INDUSTRIAL APPLICABILITY

The ultrasonic transducer according to the embodiments can be used for various types of sensors, for example, a distance measuring sensor, and as described above, can be used for a sound source of a directional speaker, an ideal impulse signal generating source and the like.

The invention claimed is:

1. An ultrasonic speaker comprising:

an ultrasonic transducer which comprises a fixed electrode having corrugations on the surface; a vibrating film having an electrode layer and disposed on the surface of said fixed electrode; and a holding member which holds said fixed electrode and said vibrating film, said ultrasonic transducer being driven by applying an AC signal between said electrode layer of said vibrating film and said fixed electrode, a signal source which generates signal waves in the audio frequency band;

a carrier wave-supply unit which generates and outputs carrier waves in the ultrasonic frequency band; and a modulating unit which modulates said carrier waves according to signal waves in the audio frequency band output from said signal source, wherein said ultrasonic transducer generates a sound pressure of at least 120 dB within a frequency range from 20 kHz to 120 kHz.

2. An ultrasonic speaker according to claim 1, wherein a fluctuation in sound pressure of 120 dB and higher within a frequency range from 20 kHz to 120 kHz is within 6 dB (±3 dB).

3. An ultrasonic speaker according to claim 1, wherein said corrugations of said fixed electrode comprise a plurality of circular grooves formed in concentric circles.

4. An ultrasonic speaker according to claim 1, wherein said corrugations of said fixed electrode comprise a plurality of elliptical grooves formed in concentric ellipses.

5. An ultrasonic speaker according to claim 1, wherein said corrugations of said fixed electrode comprise a plurality of straight line grooves.

6. An ultrasonic speaker according to claim 1, wherein said corrugations of said fixed electrode comprise a plurality of free-form curved grooves.

7. An ultrasonic speaker according to claim 1, wherein the cross-sectional shape of said corrugations is made in any one of a rectangular shape, a tapered shape, and with a lower portion of an approximately semicircular shape.

8. An ultrasonic speaker according to claim 1, wherein said corrugations of said fixed electrode comprise a plurality of cylindrical holes.

9. An ultrasonic speaker according to claim 2, wherein said corrugations of said fixed electrode comprise a plurality of conical holes.

10. An ultrasonic speaker according to claim 1, wherein said corrugations of said fixed electrode comprise grooves of any one of; a plurality of circular grooves formed in concentric circles, a plurality of elliptical grooves formed in concentric ellipses, and a plurality of straight line grooves, or a combination of such grooves, and holes of either one of a plurality of cylindrical holes and a plurality of conical holes, or a combination of such holes.

11. An ultrasonic speaker according to claim 1, wherein a groove portion or continuously disposed holes are provided on the upper surface of protrusions of said corrugations of said fixed electrode.

12. An ultrasonic speaker according to claim 11, wherein said groove portion is formed in a continuous groove shape.

13. An ultrasonic speaker according to claim 12, wherein said groove portion comprises a plurality of circular grooves formed in concentric circles.

14. An ultrasonic speaker according to claim 12, wherein said groove portion comprises a plurality of elliptical grooves formed in concentric ellipses.

15. An ultrasonic speaker according to claim 12, wherein said groove portion comprises a plurality of straight line grooves.

16. An ultrasonic speaker according to claim 12, wherein said groove portion comprises a plurality of free-form curved grooves.

17. An ultrasonic speaker according to claim 11, wherein the cross-sectional shape of said groove portion is made in any one of a rectangular shape, a tapered shape, and with a lower portion of an approximately semicircular shape.

18. An ultrasonic speaker according to claim 11, wherein said holes are formed as a plurality of cylindrical holes disposed continuously in a concentric circle shape or in a straight line shape.

19. An ultrasonic speaker according to claim 11, wherein said holes are formed as a plurality of conical holes disposed continuously in a concentric circle shape or in a straight line shape.

20. An ultrasonic speaker according to claim 1, wherein said fixed electrode comprises a single conductive member.

21. An ultrasonic speaker according to claim 1, wherein said fixed electrode comprises a plurality of conductive members.

22. An ultrasonic speaker according to claim 1, wherein said vibrating film is a thin film with said electrode layer formed on one side of a nonconductive polymer film.

23. An ultrasonic speaker according to claim 1, wherein said vibrating film is a thin film obtained by forming said electrode layer between two nonconductive polymer films.

24. An ultrasonic speaker according to claim 1, wherein a single-polarity DC bias voltage is applied to said electrode layer of said vibrating film.

25. An ultrasonic speaker according to claim 1, wherein a single-polarity DC bias voltage is applied to said fixed electrode.

26. An ultrasonic speaker according to claim 1, wherein said holding member is formed from an insulating material.

27. An ultrasonic speaker according to claim 1, wherein said vibrating film is fixed by applying tension in four right-angle directions on the film plane.

28. An ultrasonic speaker according to claim 1, wherein said ultrasonic speaker uses forced vibration under an electrostatic force generated by a drive voltage, rather than vibration at the resonance point of natural vibration.

29. An ultrasonic speaker having:

an ultrasonic transducer which comprises a fixed electrode having corrugations on the surface, a vibrating film having an electrode layer and disposed on the surface of said fixed electrode, and a holding member which holds said fixed electrode and said vibrating film;

a signal source which generates signal waves in the audio frequency band;

a carrier wave-supply unit which generates and outputs carrier waves in the ultrasonic frequency band; and a modulating unit which modulates said carrier waves according to signal waves in the audio frequency band output from said signal source, wherein said ultrasonic transducer is driven by a modulated signal output from said modulating unit and applied between said fixed electrode and the electrode layer of said vibrating film.

* * * * *